US007098851B2

(12) United States Patent
Dohata

(10) Patent No.: US 7,098,851 B2
(45) Date of Patent: Aug. 29, 2006

(54) MULTI-LAYER SUBSTRATE FOR LOW NOISE BLOCK DOWN CONVERTER

(75) Inventor: Hiroyuki Dohata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 84 days.

(21) Appl. No.: 10/761,267

(22) Filed: Jan. 22, 2004

(65) Prior Publication Data

US 2004/0189531 A1 Sep. 30, 2004

(30) Foreign Application Priority Data

Mar. 27, 2003 (JP) ..... 2003-087567

(51) Int. Cl.
*H01Q 1/38* (2006.01)

(52) U.S. Cl. ..... 343/700 MS; 343/840; 342/175

(58) Field of Classification Search ..... 343/700 MS, 343/786, 840, 909, 702; 333/26, 33; 342/70, 342/175, 372
See application file for complete search history.

(56) References Cited

U.S. PATENT DOCUMENTS 6,114,986 A * 9/2000 Cassen et al. ..... 342/175
6,249,242 B1 * 6/2001 Sekine et al. ..... 342/70
6,853,334 B1 * 2/2005 Imai ..... 343/700 MS

FOREIGN PATENT DOCUMENTS

JP 2000-332526 A 11/2000

* cited by examiner

*Primary Examiner*—Tuyet Vo
*Assistant Examiner*—Jimmy Vu
(74) *Attorney, Agent, or Firm*—Birch, Stewart, Kolasch & Birch, LLP

(57) ABSTRACT

A multi-layer substrate of the invention for a low noise block down converter includes an antenna pattern conveying electric wave signals that have been carried along a waveguide, and three ground conductive layers stacked on the antenna pattern with dielectric layers therebetween. In at least one ground conductive layer of the three ground conductive layers, conductor is absent in at least part of the region that is closer to the waveguide than the antenna pattern. This provides a multi-layer substrate for a low noise block down converter where deterioration in the passage property of electric wave signals can be restrained.

16 Claims, 22 Drawing Sheets

MULTI-LAYER SUBSTRATE FOR LOW NOISE BLOCK DOWN CONVERTER

This nonprovisional application claims priority under 35U.S.C. § 119 (a) on Patent Application No. 2003-087567 filed in Japan on Mar. 27, 2003, which is herein incorporated by reference.

BACKGROUND OF THE INVENTION

1. Field of the Invention

The present invention relates to a low noise block down converter (hereinafter referred to as an LNB) in use for satellite broadcasting, satellite communications and the like, or an LNB substrate unit incorporated therein.

2. Description of the Background Art

An LNB is a device that performs low noise amplification on received broadband signals having a plurality of channels, while converting them to a lower frequency band in batches.

Presently, to deal with an increased diversity in services such as multi-channel satellite broadcasting, one LNB receives a plurality of microwaves or one LNB is connected to a tuner via a plurality of signal input terminals. Such an LNB may have a complicated circuit structure, causing difficulties in structuring the circuit on one double-sided substrate (double-layer substrate). In a conventional LNB, therefore, signal and power supply lines are tied by joint pins and the like, enabling the use of more than one double-sided substrate. However, the use of more than one double-sided substrate results in a structure with signal and power supply lines that are tied by joint pins, resulting in a bigger, heavier LNB and a more complicated manufacturing process.

One of the solutions to this is to structure an LNB using a multi-layer substrate. A multi-layer substrate is manufactured by stacking double layer substrates and bonding them with an adhesive that serves as a dielectric layer.

Referring to FIG. 31, an LNB four-layer substrate 100 is placed on a chassis 111. LNB four-layer substrate 100 is constructed of a waveguide aperture 113, a probe 114, an antenna pattern 115, first to third ground conductive layers 116–118 and dielectric layers 131–133. Chassis 111 is connected to a waveguide 121, and waveguide aperture 113 communicating with waveguide 121 is formed in LNB four-layer substrate 100. Probe 114 protrudes from LNB four-layer substrate 100 and is located in waveguide aperture 113.

In LNB four-layer substrate 100, antenna pattern 115 is formed of the topmost conductive layer. First to third ground conductive layers 116–118 are formed of the second, third and bottommost conductive layers, respectively, when counted from top to bottom. Dielectric layers 131–133 are provided in between, sandwiched by antenna pattern 115 and first to third ground conductive layers 116–118.

First to third ground conductive layers 116–118 are electrically connected with each other via a connecting hole (not shown). Thus, first to third ground conductive layers 116–118 are at the same electric potential as chassis 111 that is at ground potential. The levels in which first to third ground conductive layers 116–118 are provided are entirely or partially constructed of conductor.

In a conventional LNB four-layer substrate 100 with the above structure, electric wave signals that have been carried along waveguide 121 are introduced into waveguide aperture 113, transmitted through probe 114 to be input into antenna pattern 115.

However, in a conventional LNB multi-layer substrate, the ground conductive layers located within are electrically separated from the housing that steadies the substrate. This tends to effect a loss of wave energy during the passage of the waves, especially when operating at high frequencies. Such deterioration in the passage property presents a problem when a multi-layer substrate is employed instead of a double-sided substrate.

Specifically, in LNB four-layer substrate 100, first ground conductive layer 116 is electrically connected to chassis 111 (ground potential) via second and third ground conductive layers 117, 118. Thus, first ground conductive layer 116 electrically interacts with second and third ground conductive layers 117, 118 and thus cannot easily be maintained at ground potential. Similarly, second ground conductive layer 117 may not easily be maintained at ground potential. This results in a problem of deterioration in the passage property of electric wave signals.

SUMMARY OF THE INVENTION

An object of the present invention is to provide an LNB multi-layer substrate where deterioration in the passage property of electric wave signals can be restrained.

A multi-layer substrate for a low noise block down converter according to the present invention includes an antenna pattern conveying a wave signal that have been carried along the waveguide, and two or more ground conductive layers stacked on the antenna pattern with dielectric layers therebetween. In at least one of the two or more ground conductive layers, conductor is absent in at least part of the region that is closer to the waveguide than the antenna pattern is.

The present inventors have found that the phenomenon of each of the two or more ground conductive layers being unable to be maintained at ground potential due to electrical interaction between the two or more ground conductive layers is particularly significant in the region close to the waveguide in the two or more ground conductive layers. Consequently, conductor is absent in at least part of the region that is closer to the waveguide than the antenna pattern is in at least one of the two or more ground conductive layers, thereby restraining electrical interaction between the two or more ground conductive layers. As a result, each of the two or more ground conductive layers is maintained at ground potential, thereby restraining deterioration in the passage property of electric wave signals.

Preferably, in the multi-layer substrate for the low noise block down converter according to the present invention, conductor is absent in the region directly below the antenna pattern in at least one of the two or more ground conductive layers.

The present inventor have found that the phenomenon of each of two or more ground conductive layers being unable to be maintained at ground potential due to electrical interaction between the two or more ground conductive layers is particularly significant in the region directly below the antenna pattern. Consequently, absence of conductor in at least one of the two or more ground conductive layers in the region directly below the antenna pattern further restrains electrical interaction between the two or more ground conductive layers. As a result, each of the two or more ground conductive layers may be maintained at ground potential, thereby restraining deterioration in the passage property of electric wave signals.

Preferably, the multi-layer substrate for the low noise block down converter according to the invention includes three ground conductive layers, where, in the same level as that in which at least one of the first and second ground conductive layers from above is provided, a dielectric layer is provided in the region that is closer to the waveguide than the antenna pattern is. Further, in the third ground conductive layer from above, a notch is provided in the region directly below the antenna pattern.

Thus, in at least one of the first and second ground conductive layers from above, conductor is absent in the region that is closer to the waveguide than the antenna pattern is. Moreover, in the third ground conductive layer from above, conductor is absent in the region directly below the antenna pattern. This may further restrain electrical interaction among the three ground conductive layers. As a result, each of the three ground conductive layers can be maintained at ground potential, thereby restraining deterioration in the passage property of electric wave signals.

Preferably, a multi-layer substrate for a low noise block down converter according to the invention includes three ground conductive layers, where a dielectric layer is provided in the region that is closer to the waveguide than the antenna pattern is in the same levels as those in which the first and second ground conductive layers from above are provided.

Accordingly, absence of the conductive layer in the region that is closer to the waveguide than the antenna pattern is in the first and second ground conductive layers from above further restrains electrical interaction among the three ground conductive layers. As a result, each of the three ground conductive layers can be maintained at ground potential, thereby restraining deterioration in the passage property of electric wave signals.

Preferably, in a multi-layer substrate for a low noise block down converter according to the invention, a waveguide aperture is provided that penetrates two or more ground conductive layers and dielectric layers. Further, conductive layers are provided around the waveguide aperture in all of the same levels as those in which the two or more ground conductive layers are provided.

In this way, even when there is a region with no conductive layer in the same levels as those in which the two or more ground conductive layers are provided, conductive layers are provided where sufficient contact is ensured with the chassis around the waveguide aperture in each of the same levels as those in which the two or more ground conductive layers are provided. This can restrain electrical interaction between the two or more ground conductive layers, while maintaining the ground potential around the waveguide aperture. As a result, deterioration in the passage property of electric wave signals can be restrained.

Preferably, a multi-layer substrate for a low noise block down converter according to the present invention includes three ground conductive layers, where, in the third ground conductive layer from above, a notch is provided in the region directly below the antenna pattern.

Thus, in the third ground conductive layer from above, conductor is absent in the region directly below the antenna pattern, such that electrical interaction among the three ground conductive layers may be restrained and the ground potential can be maintained around the waveguide aperture. As a result, deterioration in the passage property of electric wave signals can be restrained.

Preferably, a multi-layer substrate for a low noise block down converter according to the invention includes three ground conductive layers, where, in the same level as that in which the first or second ground conductive layers from above is provided, a dielectric layer is provided in at least part of the region that is closer to the waveguide than the antenna pattern is.

Thus, in the first or second ground conductive layer from above, conductor is absent in at least part of the region that is closer to the waveguide than the antenna pattern is, thereby further restraining electrical interaction among the three ground conductive layers. At the same time, the ground potential can be maintained around the waveguide aperture. As a result, deterioration in the passage property of electric wave signals can be restrained.

Preferably, in a multi-layer substrate for a low noise block down converter according to the invention, in at least two of two or more ground conductive layers, conductor is absent in at least part of the region that is closer to the waveguide than the antenna pattern is.

Thus, in at least two of the two or more ground conductive layers, conductor is absent in at least part of the region that is closer to the waveguide than the antenna pattern is, thereby further restraining electrical interaction between the two or more ground conductive layers. At the same time, the ground potential can be maintained around the waveguide aperture. As a result, each of the two or more ground conductive layers can be maintained at ground potential, thereby restraining deterioration in the passage property of electric wave signals.

Preferably, a multi-layer substrate for a low noise block down converter of the invention includes three ground conductive layers, where, in the same level as that in which the first ground conductive layer from above is provided, a dielectric layer is provided in at least part of the region that is closer to the waveguide than the antenna pattern is. Also, in the third ground conductive layer from above, a notch is provided in at least part of the region directly below the antenna pattern.

Thus, in the third ground conductive layer from above, conductor is absent in at least part of the region directly below the antenna pattern. Further, in the first ground conductive layer from above, conductor is absent in at least part of the region that is closer to the waveguide than the antenna pattern is. Thus, electrical interaction can further be restrained among the three ground conductive layers. At the same time, the ground potential can be maintained around the waveguide aperture. As a result, deterioration in the passage property of electric wave signals can be restrained.

Preferably, the multi-layer substrate for the low noise block down converter of the invention includes three ground conductive layers, where, in the same level as that in which the first or second ground conductive layer from above is provided, a dielectric layer is provided in at least part of the region that is closer to the waveguide than the antenna pattern is. Further, in the third ground conductive layer from above, a notch is provided in the region directly below the antenna pattern.

Thus, in the third ground conductive layer from above, conductor is absent in the region directly below the antenna pattern. Also, in the first or second ground conductive layer from above, conductor is absent in at least part of the region that is closer to the waveguide than the antenna pattern is. In this way, electrical interaction can further be restrained among the three ground conductive layers. At the same time, the ground potential can be maintained around the waveguide aperture. As a result, deterioration in the passage property of electric wave signals can be restrained.

Preferably, in a multi-layer substrate for a low noise block down converter of the invention, in at least two of two or more ground conductive layers, conductor is absent in the region directly below the antenna pattern.

Thus, in at least two of the two or more ground conductive layers, conductor is absent in the region directly below the antenna pattern, thereby further restraining electrical interaction between the two or more ground conductive layers. At the same time, the ground potential can be maintained around the waveguide aperture. As a result, deterioration in the passage property of electric wave signals can be restrained.

Preferably, a multi-layer substrate for a low noise block down converter of the invention includes three ground conductive layers, where, in the same level as that in which the first or second ground conductive layer from above is provided, a dielectric layer is provided in at least part of the region that is closer to the waveguide than the antenna pattern is and, in the third ground conductive layer from above, a notch is provided in the region directly below the antenna pattern.

Thus, in the third ground conductive layer from above, conductor is absent in the region directly below the antenna pattern. Further, in the first or second ground conductive layer from above, conductor is absent in at least part of the region that is closer to the waveguide than the antenna pattern is. Thus, in the two ground conductive layers, conductor is completely absent in the region directly below the antenna pattern, thereby further restraining electrical interaction among the three ground conductive layers. At the same time, the ground potential can be maintained around the waveguide aperture. As a result, deterioration in the passage property of electric wave signals can be restrained.

Preferably, a multi-layer substrate for a low noise block down converter of the invention includes three ground conductive layers, where, in the same levels as those in which the first and second ground conductive layers from above are provided, a dielectric layer is provided in at least part of the region that is closer to the waveguide than the antenna pattern is.

Thus, in the first and second ground conductive layers from above, conductor is absent in at least part of the region that is closer to the waveguide than the antenna pattern is, thereby further restraining electrical interaction among the three ground conductive layers. At the same time, the ground potential can be maintained around the waveguide aperture. As a result, deterioration in the passage property of electric wave signals can be restrained.

Preferably, in a multi-layer substrate for a low noise block down converter of the invention, a waveguide aperture is provided that penetrates two or more ground conductive layers and dielectric layers. Further, conductive layers are provided that surround the entire periphery of the waveguide aperture in all of the same levels as those in which the two or more ground conductive layers are provided.

In this way, even when there is a portion without conductor in the two or more ground conductive layers, conductive layers are provided where sufficient contact is ensured with the chassis in the entire periphery of the waveguide aperture in each of the two or more ground conductive layers. In this way, electrical interaction can be restrained between the two or more ground conductive layers, and the ground potential can be maintained in the entire periphery of the waveguide aperture. As a result, deterioration in the passage property of electric wave signals can be restrained.

Preferably, a multi-layer substrate for a low noise block down converter of the invention includes three ground conductive layers, where, in the same level as that in which the first or second ground conductive layer from above is provided, a dielectric layer is provided in at least part of the region that is closer to the waveguide than the antenna pattern is. Further, in the third ground conductive layer from above, a notch is provided in part of the region directly below the antenna pattern.

Thus, in the third ground conductive layer from above, conductor is absent in at least part of the region directly below the antenna pattern. Also, in the first or second ground conductive layer from above, conductor is absent in at least part of the region that is closer to the waveguide than the antenna pattern is. Consequently, in two ground conductive layers, conductor is absent in at least part of the region that is closer to the waveguide than the antenna pattern is, thereby further restraining electrical interaction among the three ground conductive layers. At the same time, the ground potential can be maintained in the entire periphery of the waveguide aperture in all of the three ground conductive layers. As a result, deterioration in the passage property of electric wave signals may be restrained.

Preferably, a multi-layer substrate for a low noise block down converter of the invention includes three ground conductive layers, where, in the same level as that in which the first or second ground conductive layer from above is provided, a dielectric layer is provided in at least part of the region that is closer to the waveguide than the antenna pattern is.

Thus, in the region directly below the antenna pattern, in the first and second ground conductive layers from above, conductor is absent in at least part of the region that is closer to the waveguide than the antenna pattern is, thereby further restraining electrical interaction among the three ground conductive layers. At the same time, the ground potential can be maintained in the entire periphery of the waveguide aperture. As a result, deterioration in the passage property of electric wave signals can be restrained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, preferred embodiments of the present invention are described with reference to the accompanying drawings.

First Embodiment

Figure 1:
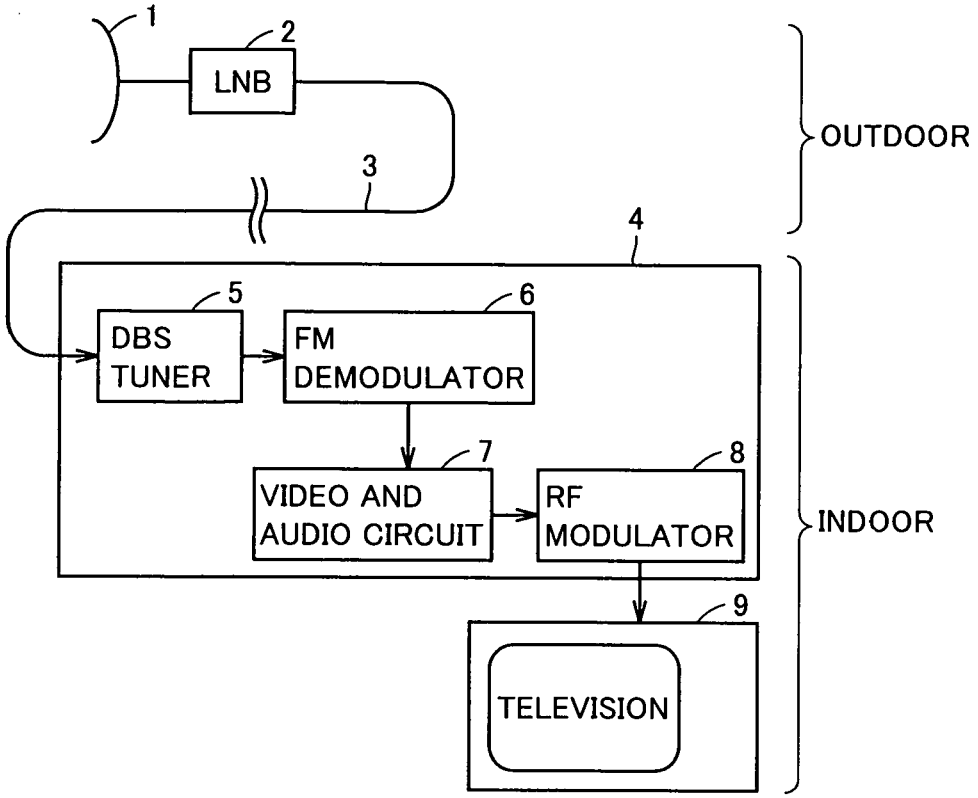
FIG. 1 is a block diagram of a satellite broadcasting reception system where an LNB according to a first embodiment of the invention is used.

Referring to FIG. 1, a satellite broadcasting reception system according to the present embodiment is generally composed of an outdoor section and an indoor section. The outdoor section is composed of an antenna 1 and an LNB 2 connected to antenna 1. The indoor section is composed of an indoor receiver 4 and a television 9.

LNB 2 amplifies electric waves received at antenna 1 from a satellite, and supplies low-noise signals of a sufficient level to indoor receiver 4 via a coaxial cable 3. Indoor receiver 4 is composed of a direct broadcasting by satellite (DBS) tuner 5, a frequency modulation (FM) demodulator 6, a video and audio circuit 7, and a radio frequency (RF) modulator 8. Signals that are provided from LNB 2 to indoor receiver 4 via coaxial cable 3 are processed in DSB tuner 5, FM demodulator 6, video and audio circuit 7 and RF modulator 8. The processed signals are provided to television 9.

Figure 2:
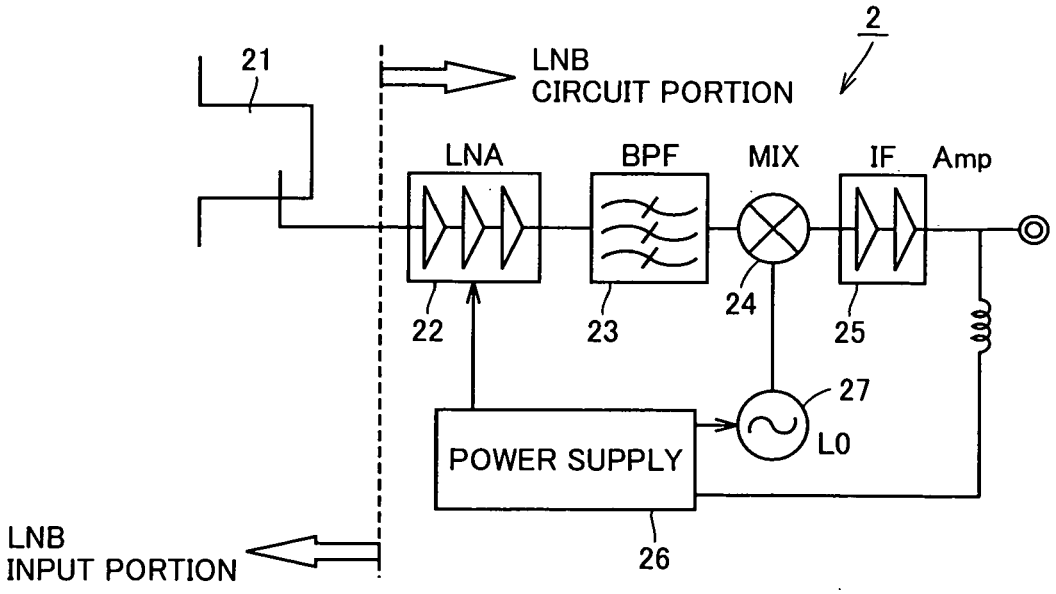
FIG. 2 is a block diagram illustrating the LNB of FIG. 1.

Now, the LNB shown in FIG. 1 will be described. Referring to FIG. 2, LNB 2 has a low noise amplifier (LNA) 22, a band pass filter (BPF) 23, a hybrid circuit 24, an intermediate frequency (IF) amplifier 25, a power supply 26, and a local oscillator (LO) 27.

LNA 22 is connected to a waveguide 21. LNA 22 is also connected to BPF 23, while hybrid circuit 24 is connected to LO 27. LNA 22 and LO 27 are powered by power supply 26. Hybrid circuit 24 is connected to LO 27. Further, hybrid circuit 24 is connected to BPF 23 and IF amplifier 25. IF amplifier 25 is connected to power supply 26 via a coil.

The structure of LNB 2 will now be described.

Figure 3:
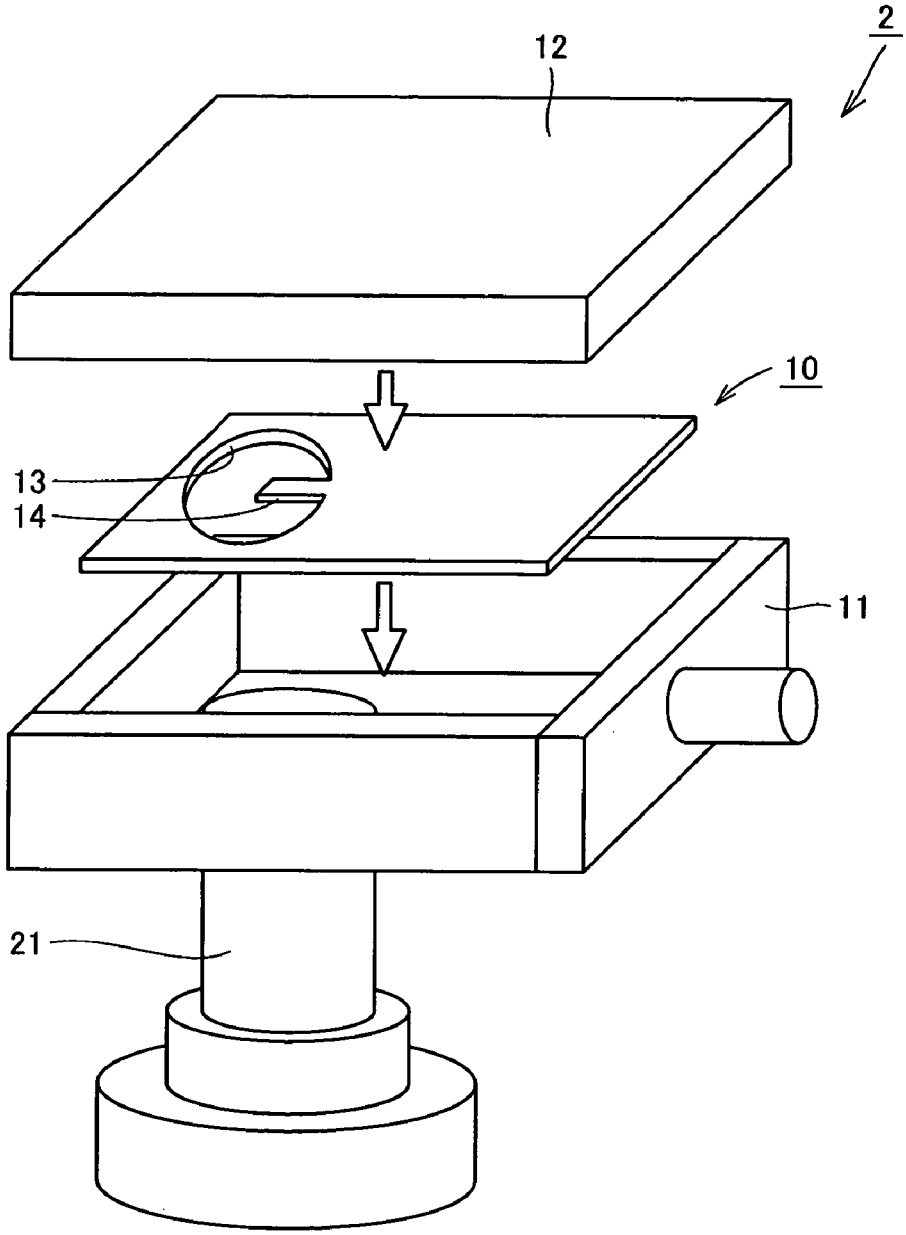
FIG. 3 is an exploded perspective view illustrating the structure of the LNB of the first embodiment of the invention.

Referring to FIG. 3, LNB 2 is composed of a chassis 11, an LNB four-layer substrate 10, a frame 12, and a waveguide 21. LNB four-layer substrate 10 is contained by chassis 11 and frame 12. Waveguide 21 is connected to chassis 11. LNB four-layer substrate 10 has a waveguide aperture 13, within which a probe 14 is located.

In LNB 2, wave signals that have been carried along waveguide 21 and waveguide aperture 13 are provided to LNA 22 (FIG. 2) of LNB four-layer substrate 10 via probe 14. Chassis 11 steadies LNB four-layer substrate 10, provides a ground field that is common to an external terminal and LNB four-layer substrate 10, and serves as a waveguide for conveying high frequency wave signals that have been reflected by the antenna. Frame 12 conveys signals to the substrate circuit in combination with chassis 11, and serves as an electric wave shield and as a ground together with chassis 11, and functions to hermetically seal the LNB converter.

Figure 4:
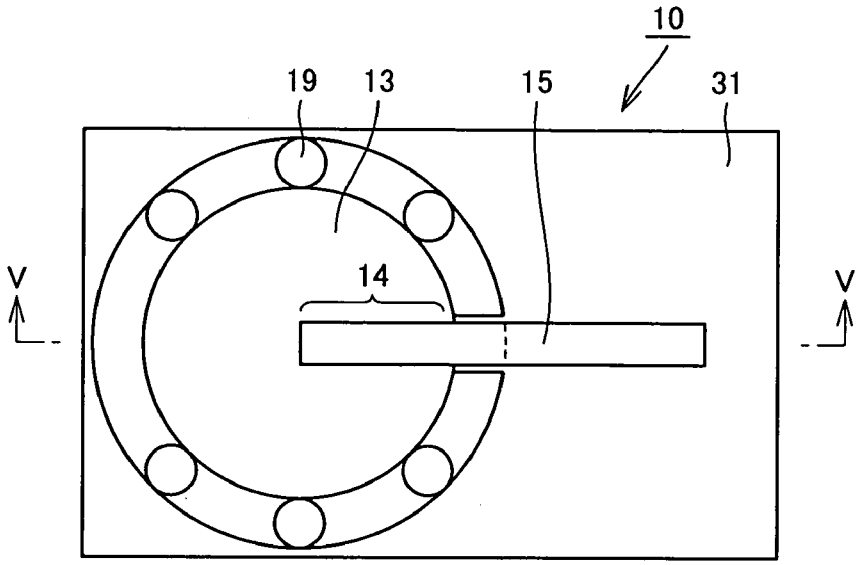
FIG. 4 is a plan view illustrating an LNB four-layer substrate according to the first embodiment of the invention.
Figure 5:
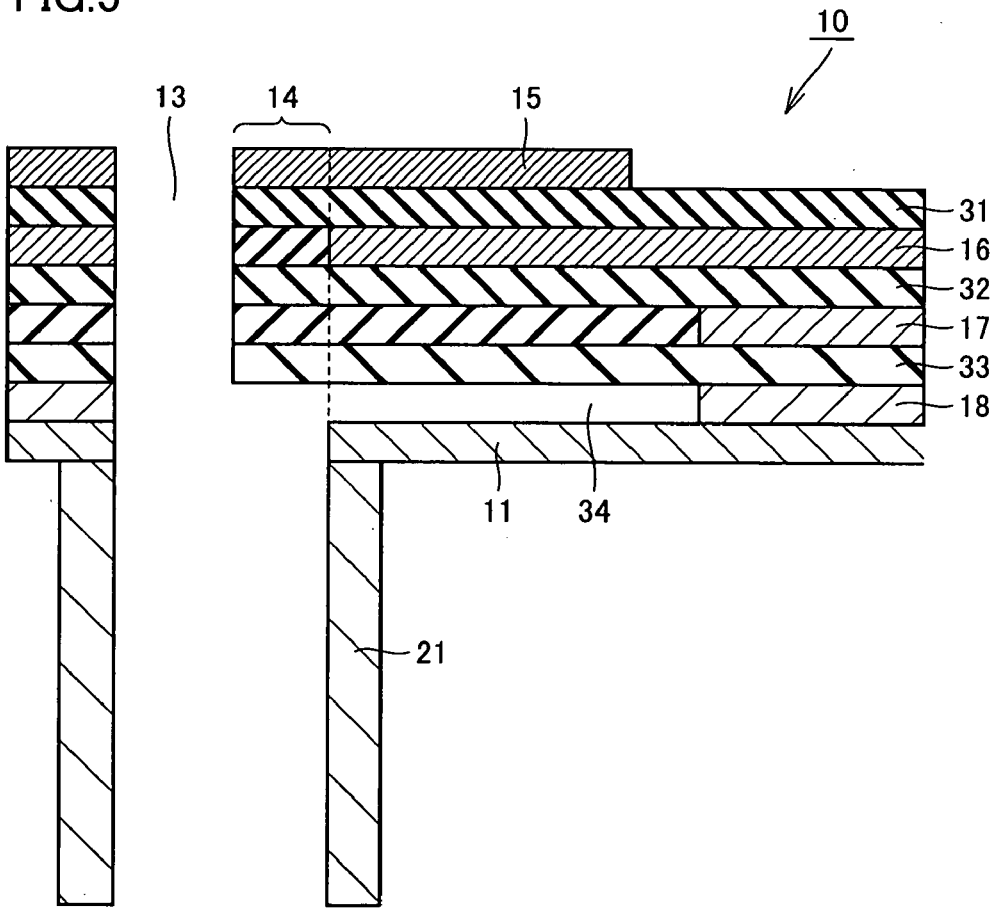
FIG. 5 is a cross sectional view taken along lines V—V of FIG. 4.

Referring to FIGS. 4 and 5, LNB four-layer substrate 10 is placed on chassis 11. LNB four-layer substrate 10 includes waveguide aperture 13, probe 14, antenna pattern 15, first to third ground conductive layers 16–18, and dielectric layers 31–33. Chassis 11 is connected to waveguide 21, and waveguide aperture 13 is formed within LNB four-layer substrate 10 to communicate with waveguide 21. Probe 14 protrudes from LNB four-layer substrate 10 and is located within waveguide aperture 13.

In LNB four-layer substrate 10, antenna pattern 15 is formed of the topmost conductive layer. Ground conductive layers 16–18 are stacked on antenna pattern 15 with dielectric layers 31–33 therebetween. More specifically, first ground conductive layer 16 is formed of, when counted from top to bottom, the second conductive layer, second ground conductive layer 17 is formed of the third conductive layer, and third ground conductive layer 18 is formed of the bottommost conductive layer. Dielectric layer 31 is provided between antenna pattern 15 and first ground conductive layer 16, dielectric layer 32 is provided between first and second ground conductive layers 16 and 17, and dielectric layer 33 is provided between second and third ground conductive layers 17 and 18.

First to third ground conductive layers 16–18 are electrically connected to each other by a connecting hole 19 formed around waveguide aperture 13. This allows first to third ground conductive layers 16–18 to be at the same potential as chassis 11 that is at ground potential.

In the present embodiment, the structure of second and third ground conductive layers 17, 18 deserves particular attention. Specifically, referring to FIG. 6, first ground conductive layer 16 of the present embodiment is made of a conductive layer 40 over the entire surface. This structure is the same as that of a conventional ground conductive layer. However, referring to FIG. 7, in the same level as that in which second ground conductive layer 17 of the present embodiment is provided, a dielectric layer 42 is provided across region 30 which is closer to waveguide 21 than antenna pattern 15 is. Further, referring to FIG. 8, in third ground layer 18 of the present embodiment, a notch 34 is provided in the region directly below antenna pattern 15.

Figure 9:
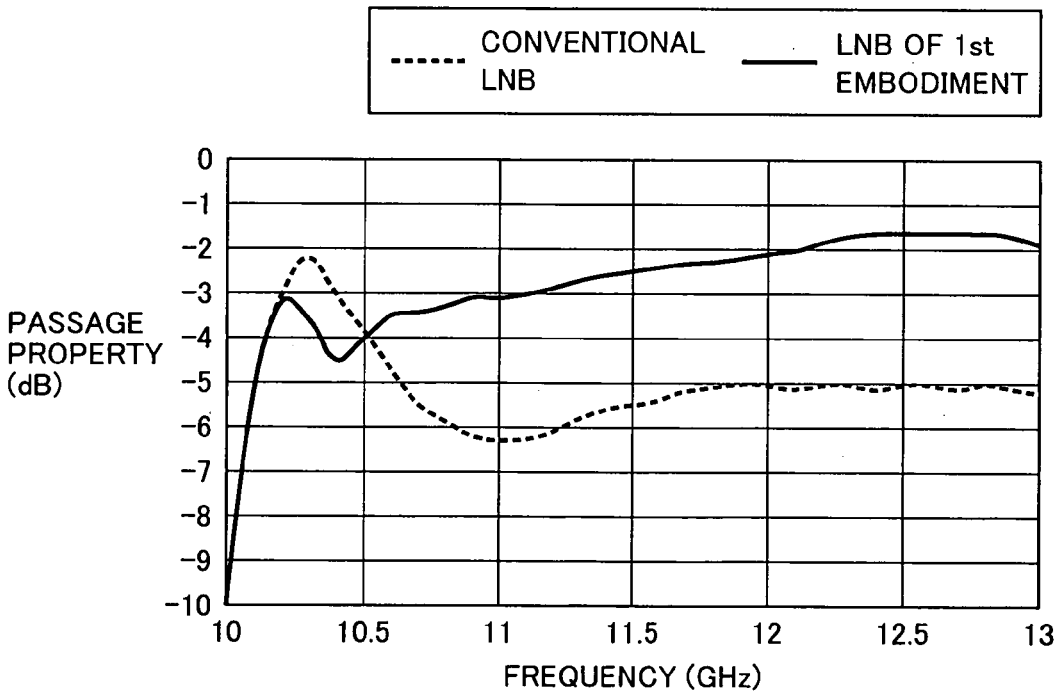
FIG. 9 illustrates the relationship between the passage property and the frequency in each of a conventional LNB and the LNB according to the first embodiment of the invention.

The present inventors evaluated the passage property in an LNB with LNB four-layer substrate 10 of the present embodiment and that in an LNB with a conventional LNB four-layer substrate 100. In FIG. 9, the axis of ordinates for the passage property means the passage property from waveguide 21 to probe 14.

The results shown in FIG. 9 illustrate that LNB 2 of the present embodiment has a higher passage property at frequencies of 10.5–13 GHz.

In LNB four-layer substrate 10 of the present embodiment, a dielectric layer 42 is provided in region 30 that is closer to waveguide 21 than antenna pattern 15 is in the same level as that in which second ground conductive layer 17 is provided. Further, in third ground conductive layer 18, a notch 34 is provided in the region directly below antenna pattern 15.

Thus, in second ground conductive layer 17, conductor of conductive layer 40 is absent in region 30 that is closer to waveguide 21 than antenna pattern 15 is. Also, in third ground conductive layer 18, conductor of conductive layer 40 is absent in the region directly below antenna pattern 15. This restrains electrical interaction among three ground conductive layers 16–18. As a result, each of three ground conductive layers 16–18 can be maintained at ground potential, thereby restraining deterioration in the passage property of electric wave signals.

Although the present embodiment illustrates the LNB multi-layer substrate as a four-layer substrate 10, the present invention is not limited thereto and any multi-layer substrate with two or more ground conductive layers may be used. Further, although the present embodiment shows dielectric layer 42 formed in region 30 that is closer to waveguide 21 than antenna pattern 15 is in the same level as that in which second ground conductive layer 17 is provided, the present invention is not limited thereto and it suffices if, in at least one of the two or more ground conductive layers, conductor is absent in at least part of the region that is closer to the waveguide than the antenna pattern is, and preferably conductor is absent in the region directly below the antenna pattern.

Second Embodiment

Figure 6:
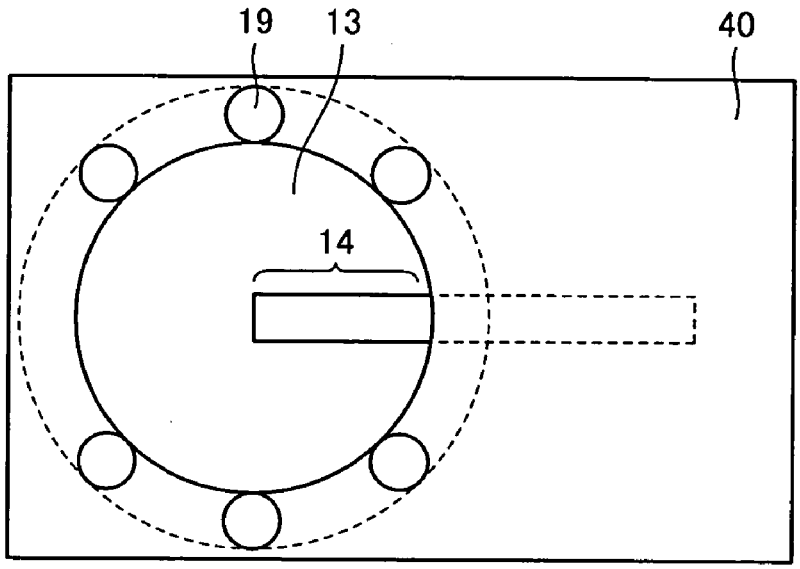
FIGS. 6 to 8 are plan views illustrating the first to third ground conductive layers, respectively, in the LNB four-layer substrate 4 according to the first embodiment, for example, of the present invention.
Figure 7:
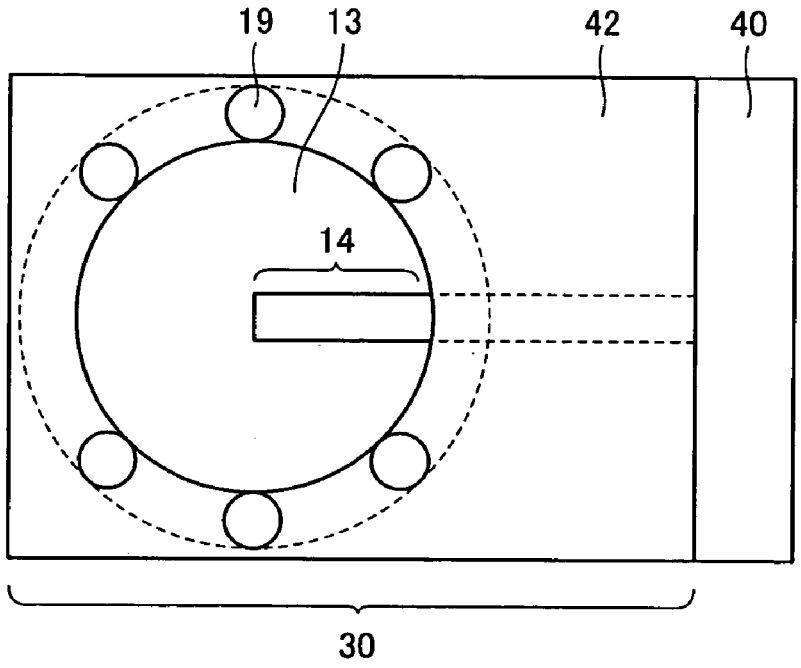
Figure 8:
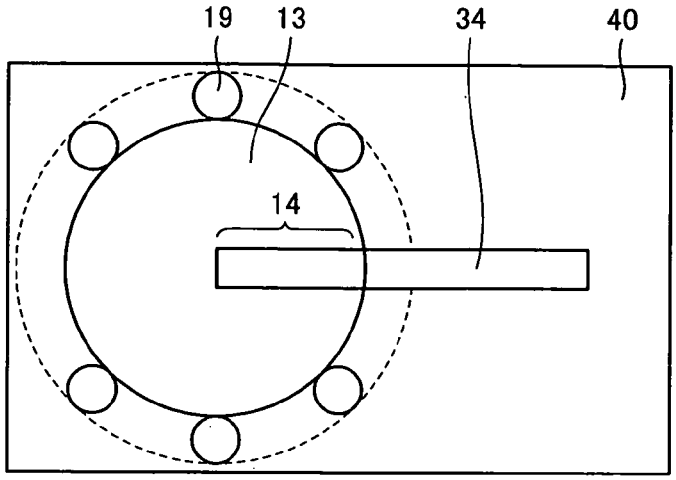
Figure 10:
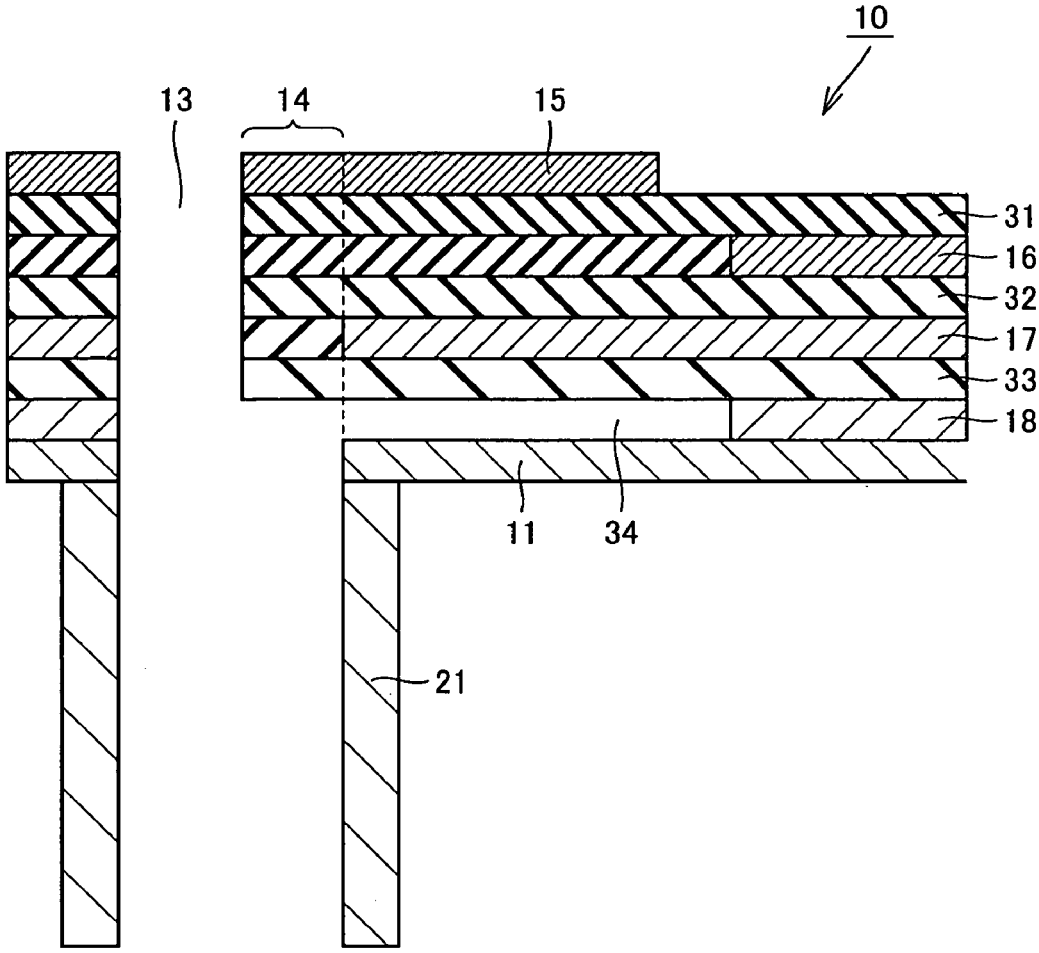
FIGS. 10 to 12 are cross sectional views illustrating LNB four-layer substrates according to second to fourth embodiments, respectively, of the invention.

Referring to FIG. 10, in an LNB four-layer substrate 10 according to the present embodiment, a first ground conductive layer 16 is formed of the ground conductive layer of FIG. 7, a second ground conductive layer 17 is formed of the ground conductive layer of FIG. 6, and a third ground conductive layer 18 is formed of the ground conductive layer of FIG. 8.

The remaining structure is generally the same as in the first embodiment shown in the FIGS. 1–4, and like components are provided with like reference designations and are not further described.

In the present embodiment, conductor of conductive layer 40 is absent in region 30 that is closer to waveguide 21 than antenna pattern 15 is in first ground conductive layer 16. Also, conductor of conductive layer 40 is absent in the region directly below antenna pattern 15 in third ground conductive layer 18. This restrains electrical interaction among three ground conductive layers 16–18. As a result, each of three ground conductive layers 16–18 may be maintained at ground potential, thereby restraining deterioration in the passage property of electric wave signals.

Third Embodiment

Figure 11:
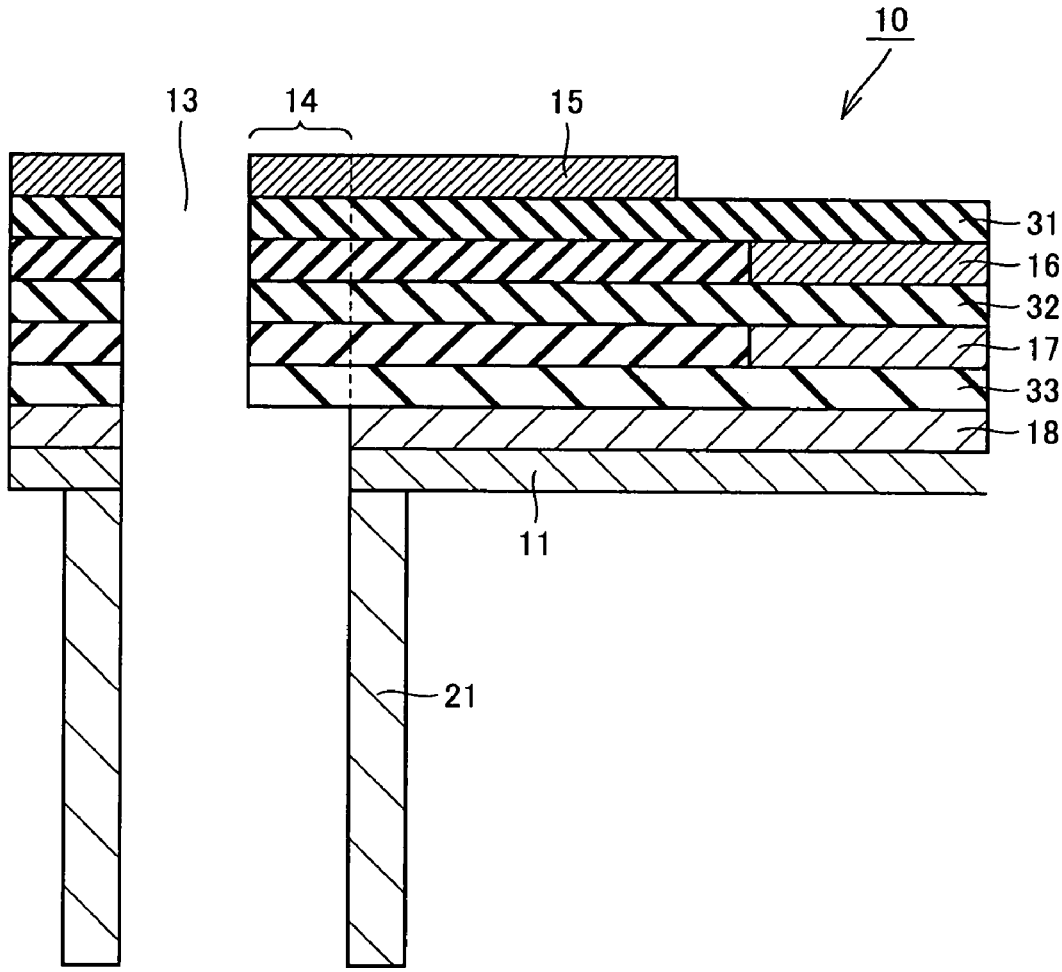

Referring to FIG. 11, in an LNB four-layer substrate 10 according to the present embodiment, first and second ground conductive layers 16 and 17 are formed of the ground conductive layer of FIG. 7, and a third ground conductive layer 18 is formed of the ground conductive layer of FIG. 6.

The remaining structure is generally the same as in the first embodiment shown in FIGS. 1–4, and like components are provided with like reference designations and are not further described.

In the present embodiment, conductor of conductive layer 40 is absent in region 30 that is closer to waveguide 21 than antenna pattern 15 is in first and second ground conductive layers 16 and 17, further restraining electrical interaction among three ground conductive layers 16–18. As a result, each of three ground conductive layers 16–18 may be maintained at ground potential, thereby restraining deterioration in the passage property of electric wave signals.

Fourth Embodiment

Figure 12:
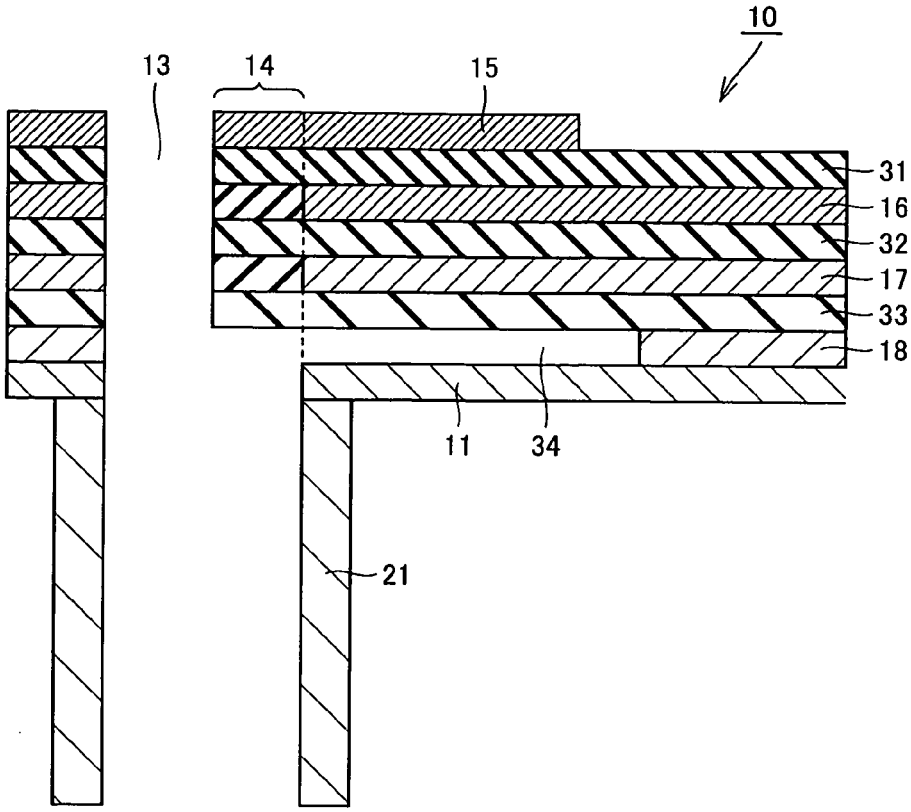

Referring to FIG. 12, in an LNB four-layer substrate 10 according to the present embodiment, first and second ground conductive layers 16 and 17 are formed of the ground conductive layer of FIG. 6, and a third ground conductive layer 18 is formed of the ground conductive layer of FIG. 8.

The remaining structure is generally the same as in the first embodiment shown in FIGS. 1–4, and like components are provided with like reference designations and are not further described.

The present inventors evaluated the passage property in an LNB with LNB four-layer substrate 10 of the present embodiment and that in an LNB with a conventional LNB four-layer substrate 100.

Figure 13:
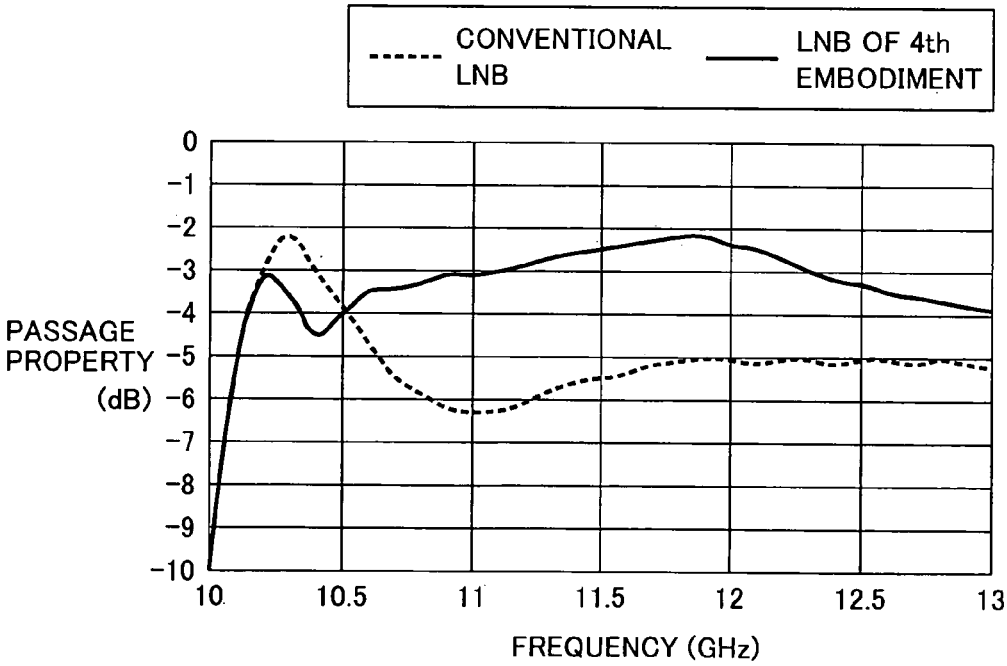
FIG. 13 illustrates the relationship between the passage property and the frequency in each of a conventional LNB and the LNB of the fourth embodiment of the invention.

The results of FIG. 13 illustrate that the LNB of the present embodiment has a higher passage property at frequencies of 10.5–13 GHz.

In the present embodiment, conductor of conductive layer 40 is absent in the region directly below antenna pattern 15 in third ground conductive layer 18, thereby restraining electrical interaction among three ground conductive layers 16–18. Further, in three ground conductive layers 16–18, the portion of third ground conductive layer 18 except in the region directly below antenna pattern 15 is formed of conductive layer 40, such that conductive layer 40 is present along a periphery 43 of waveguide aperture 13 in all of three ground conductive layers 16–18. In this way, the ground potential can be maintained in periphery 43 of waveguide aperture 13. As a result, deterioration in the passage property of electric wave signals may be restrained.

Although the present embodiment shows notch 34 in the region directly below antenna pattern 15 in third ground conductive layer 18, the present invention is not limited thereto and it suffices if conductive layers are formed around the waveguide aperture in all of the three ground conductive layers.

Fifth Embodiment

Figure 14:
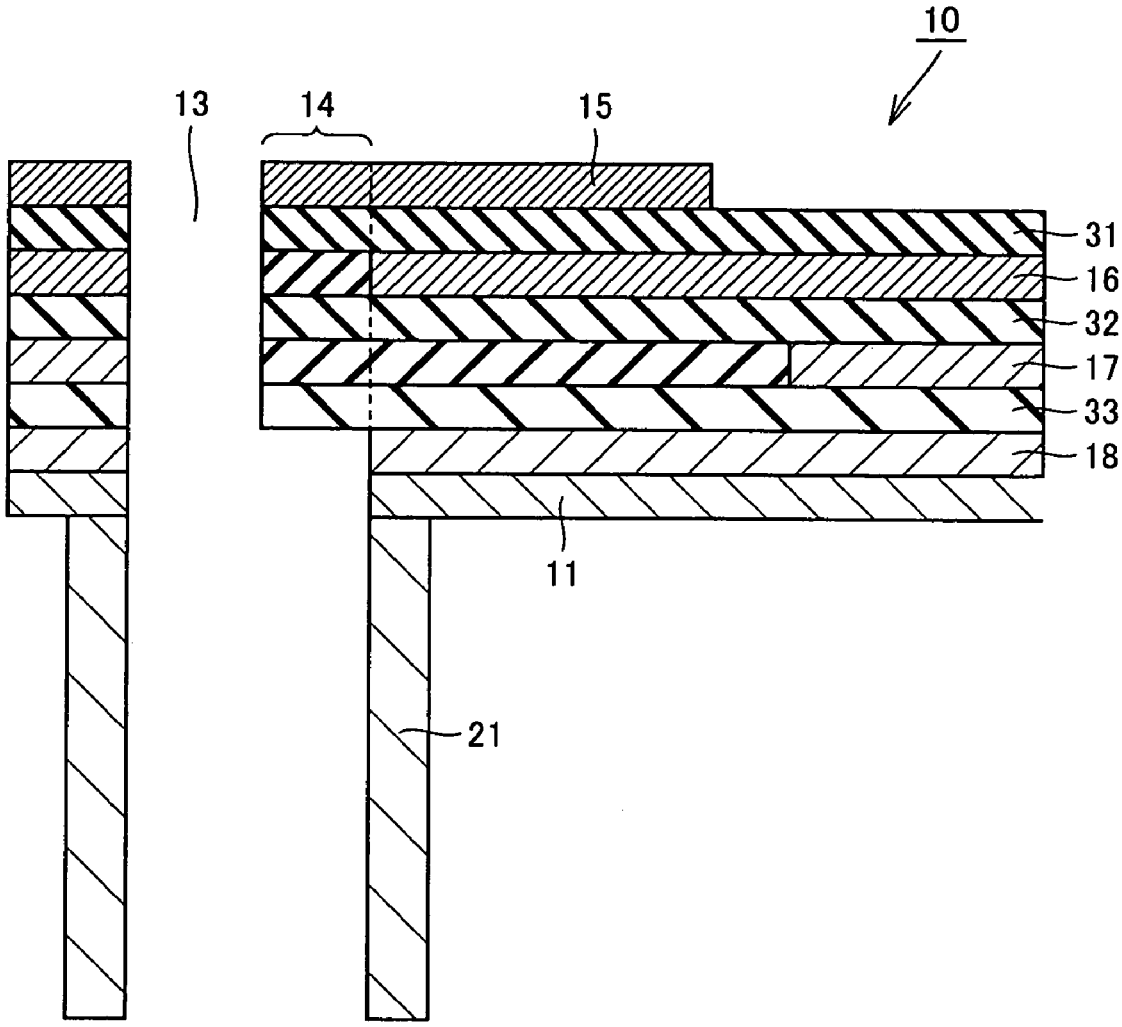
FIG. 14 is a cross sectional view illustrating an LNB four-layer substrate according to a fifth embodiment of the invention.
Figure 15:
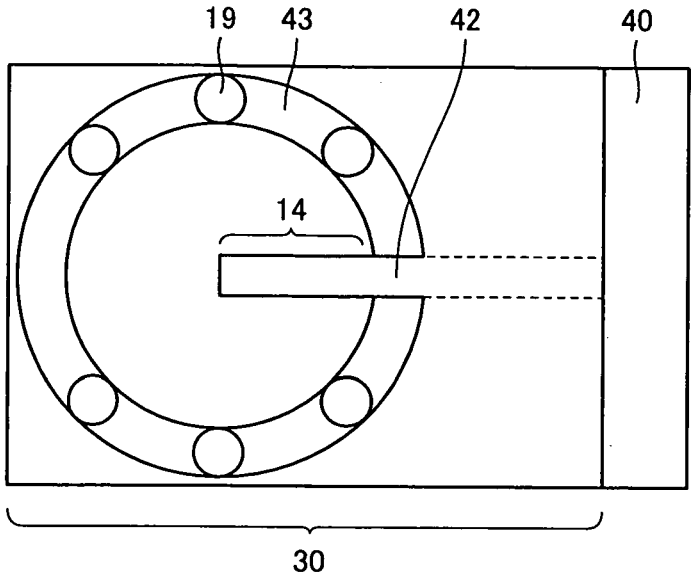
FIG. 15 is a plan view illustrating the second ground conductive layer of the LNB four-layer substrate according to the fifth embodiment, for example, of the invention.

Referring to FIG. 14, in an LNB four-layer substrate 10 of the present embodiment, first and third ground conductive layers 16 and 18 are formed of the ground conductive layer of FIG. 6, and a second ground conductive layer 17 is formed of the ground conductive layer of FIG. 15.

Referring to FIG. 15, in the same level as that in which second ground conductive layer 17 of the present embodiment is provided, a conductive layer 40 is provided along periphery 43 of waveguide aperture 13 except in the region directly below antenna pattern 15. Further, except in the region of conductive layer 40, a dielectric layer 42 is formed in region 30 that is closer to waveguide 21 than antenna pattern 15 is.

The remaining structure is generally the same as in the first embodiment shown in FIGS. 1–4, and like components are provided with like reference designations and are not further described.

In the present embodiment, in second ground conductive layer 17, conductor of conductive layer 40 is absent in region 30 that is closer to waveguide 21 than antenna pattern 15 is except in periphery 43 of waveguide aperture 13, thereby further restraining electrical interaction among three ground conductive layers 16–18. At the same time, the ground potential may be maintained along periphery 43 of waveguide aperture 13. As a result, deterioration in the passage property of electric wave signals may be restrained.

Sixth Embodiment

Figure 16:
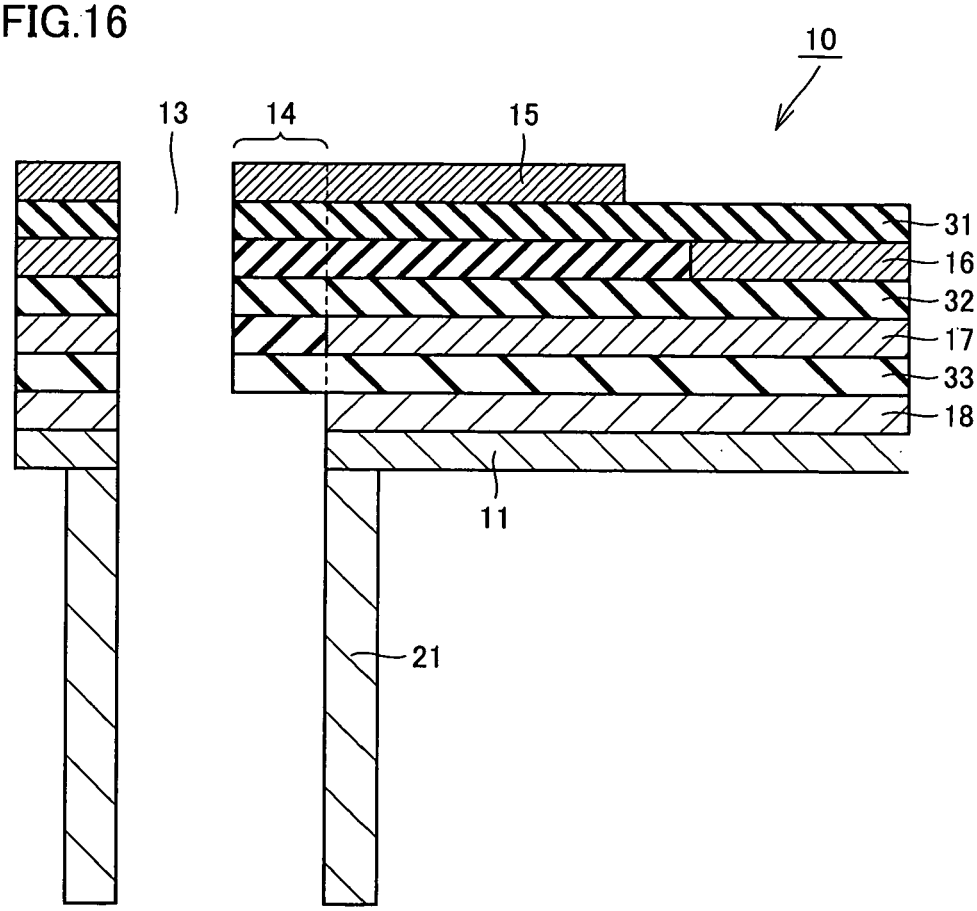
FIGS. 16 and 17 are cross sectional views illustrating LNB four-layer substrates according to sixth and seventh embodiments, respectively, of the invention.

Referring to FIG. 16, in an LNB four-layer substrate 10 of the present embodiment, a first ground conductive layer 16 is formed of the ground conductive layer of FIG. 15, and second and third ground conductive layers 17 and 18 are formed of the ground conductive layer of FIG. 6.

The remaining structure is generally the same as in the first embodiment of FIGS. 1–4, and like components are provided with like reference designations and are not further described.

In the present embodiment, in first ground conductive layer 16, conductor of conductive layer 40 is absent in region 30 that is closer to waveguide 21 than antenna pattern 15 is except in periphery 43 of waveguide aperture 13, thereby further restraining electrical interaction among three ground conductive layers 16–18. At the same time, the ground potential may be maintained along periphery 43 of waveguide aperture 13. As a result, deterioration in the passage property of electric wave signals can be restrained.

Seventh Embodiment

Figure 17:
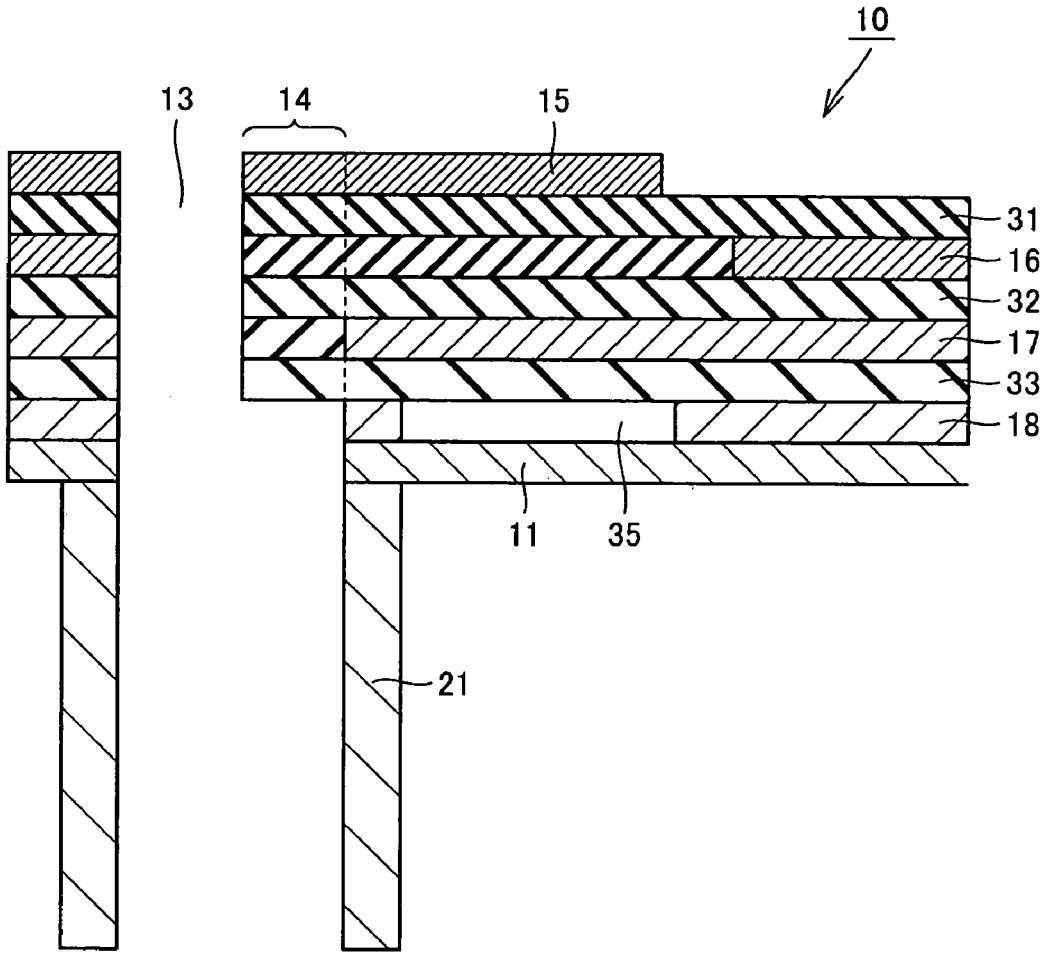
Figure 18:
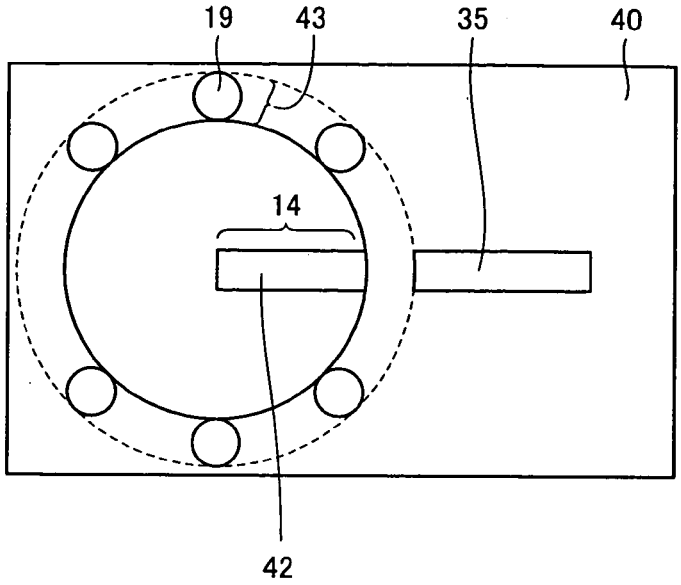
FIG. 18 is a plan view illustrating the third ground conductive layer of the LNB four-layer substrate of the seventh embodiment, for example, of the invention.

Referring to FIG. 17, in an LNB four-layer substrate 10 of the present embodiment, a first ground conductive layer 16 is formed of the ground conductive layer of FIG. 15, a second ground conductive layer 17 is formed of the ground conductive layer of FIG. 6, and a third ground conductive layer 18 is formed of the ground conductive layer of FIG. 18.

Referring to FIG. 18, in third ground conductive layer 18 of the present embodiment, a notch 35 is provided in the region directly below antenna pattern 15 except in the entire periphery 43 of waveguide aperture 13.

The remaining structure is generally the same as in the first embodiment of FIGS. 1–4, and like components are provided with like reference designations and are not further described.

The present inventors evaluated the passage property in an LNB with LNB four-layer substrate 10 of the present embodiment and that in an LNB with a conventional LNB four-layer substrate 100.

Figure 19:
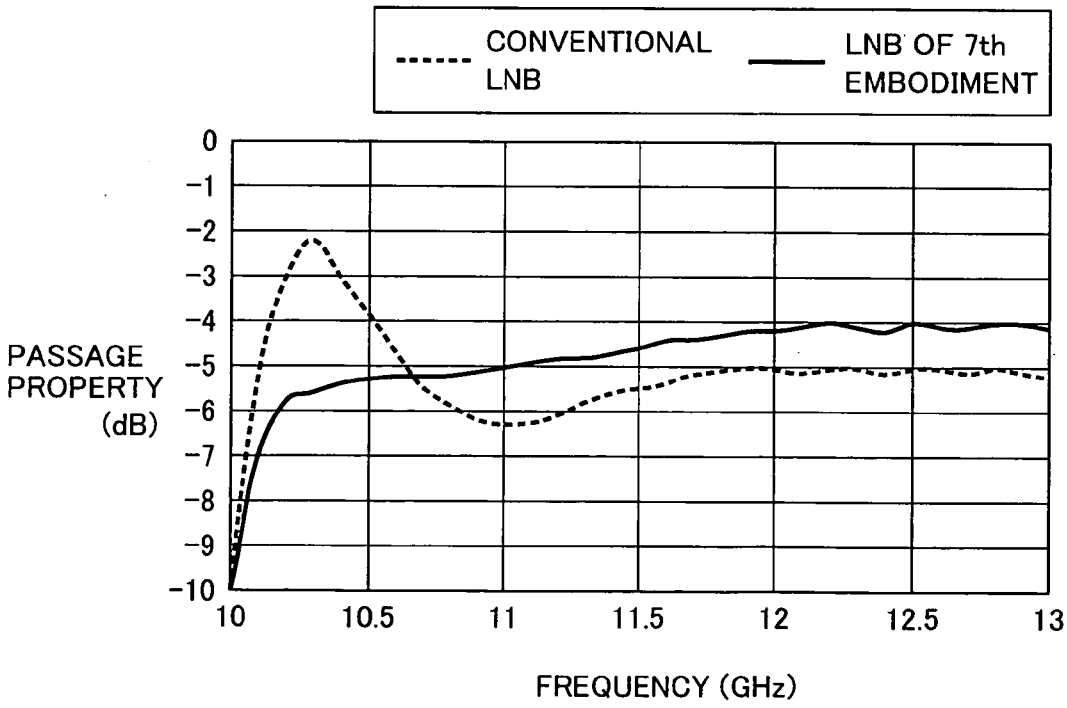
FIG. 19 illustrates the relationship between the passage property and the frequency in each of a conventional LNB and the LNB of the seventh embodiment of the invention.

The results of FIG. 19 illustrate that the LNB of the present embodiment has a higher passage property at frequencies of 10.7–13 GHz.

In the present embodiment, in first ground conductive layer 16, conductor of conductive layer 40 is absent in region 30 that is closer to waveguide 21 than antenna pattern 15 is except in the entire periphery 43 of waveguide aperture 13. Also, in third ground conductive layer 18, conductor of conductive layer 40 is absent in the region directly below antenna pattern 15. Thus, conductor of conductive layer 40 is absent in part of region 30 that is closer to waveguide 21 than antenna pattern 15 is in two ground conductive layers 16 and 18, thereby further restraining electrical interaction among three ground conductive layers 16–18. At the same time, the ground potential may be maintained along periphery 43 of waveguide aperture 13. As a result, deterioration in the passage property of electric wave signals may be restrained.

Although the present embodiment shows first ground conductive layer 16 formed of the ground conductive layer of FIG. 15 and third ground conductive layer 18 formed of the ground conductive layer of FIG. 18, the present invention is not limited thereto and it suffices if conductor is absent in at least part of the region that is closer to the waveguide than the antenna pattern is in at least two ground conductive layers.

Eighth Embodiment

Figure 20:
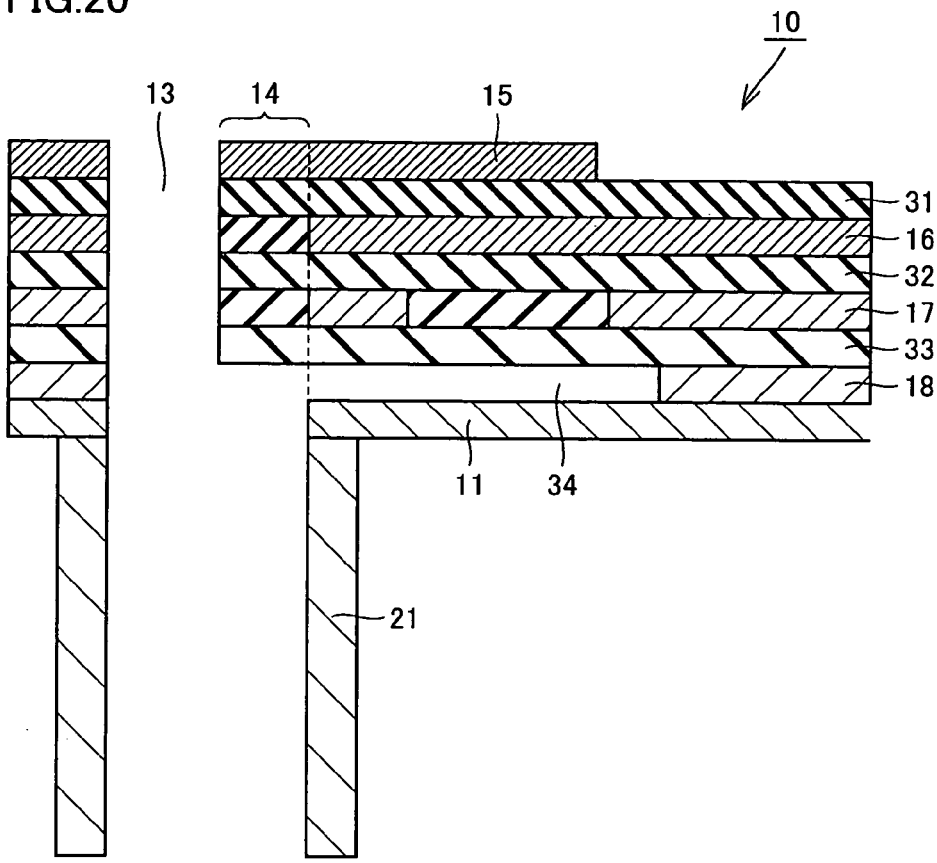
FIG. 20 is a cross sectional view illustrating an LNB four-layer substrate in an eighth embodiment of the invention.
Figure 21:
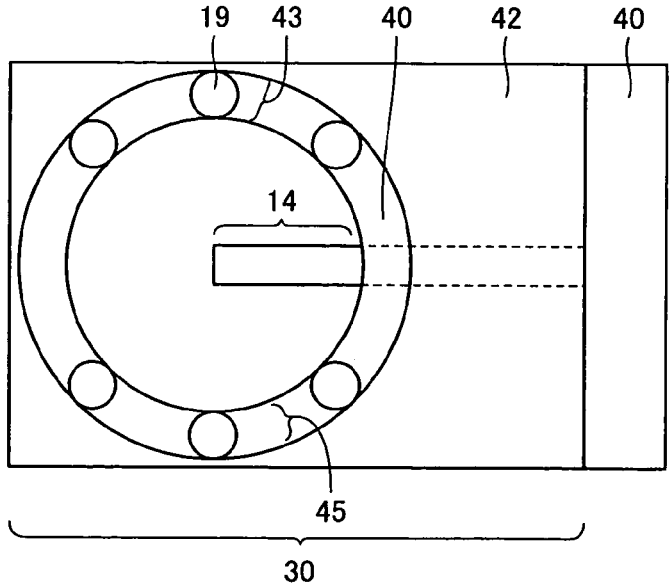
FIG. 21 is a plan view illustrating the second ground conductive layer in the LNB four-layer substrate of the eighth embodiment, for example, of the invention.

Referring to FIG. 20, in an LNB four-layer substrate 10 according to the present embodiment, a first ground conductive layer 16 is formed of the ground conductive layer of FIG. 6, a second ground conductive layer 17 is formed of the ground conductive layer of FIG. 21, and a third ground conductive layer 18 is formed of the ground conductive layer of FIG. 8.

Referring to FIG. 21, in the same level as that in which second ground conductive layer 17 of the present embodiment is provided, a conductive layer 40 surrounds the entire periphery 43 of waveguide aperture 13. Except in the region of conductive layer 40, a dielectric layer 42 is formed in region 30 that is closer to waveguide 21 than antenna pattern 15 is.

The remaining structure is generally the same as in the first embodiment of FIGS. 1–4, and like components are provided with like reference designations and are not further described.

In the present embodiment, in third ground conductive layer 18, conductor of conductive layer 40 is absent in the region directly below antenna pattern 14. Also, in second ground conductive layer 17, conductor of conductive layer 40 is absent in region 30 that is closer to waveguide 21 than antenna pattern 15 is except in the entire periphery 43 of waveguide aperture 13. Thus, conductor of conductive layer 40 is absent in part of region 30 that is closer to waveguide 21 than antenna pattern 15 is in two ground conductive layers 17, 18, thereby further restraining electrical interaction among three ground conductive layers 16–18. At the same time, the ground potential may be maintained in periphery 43 of waveguide aperture 13. As a result, deterioration in the passage property of wage signals may be restrained.

Ninth Embodiment

Figure 22:
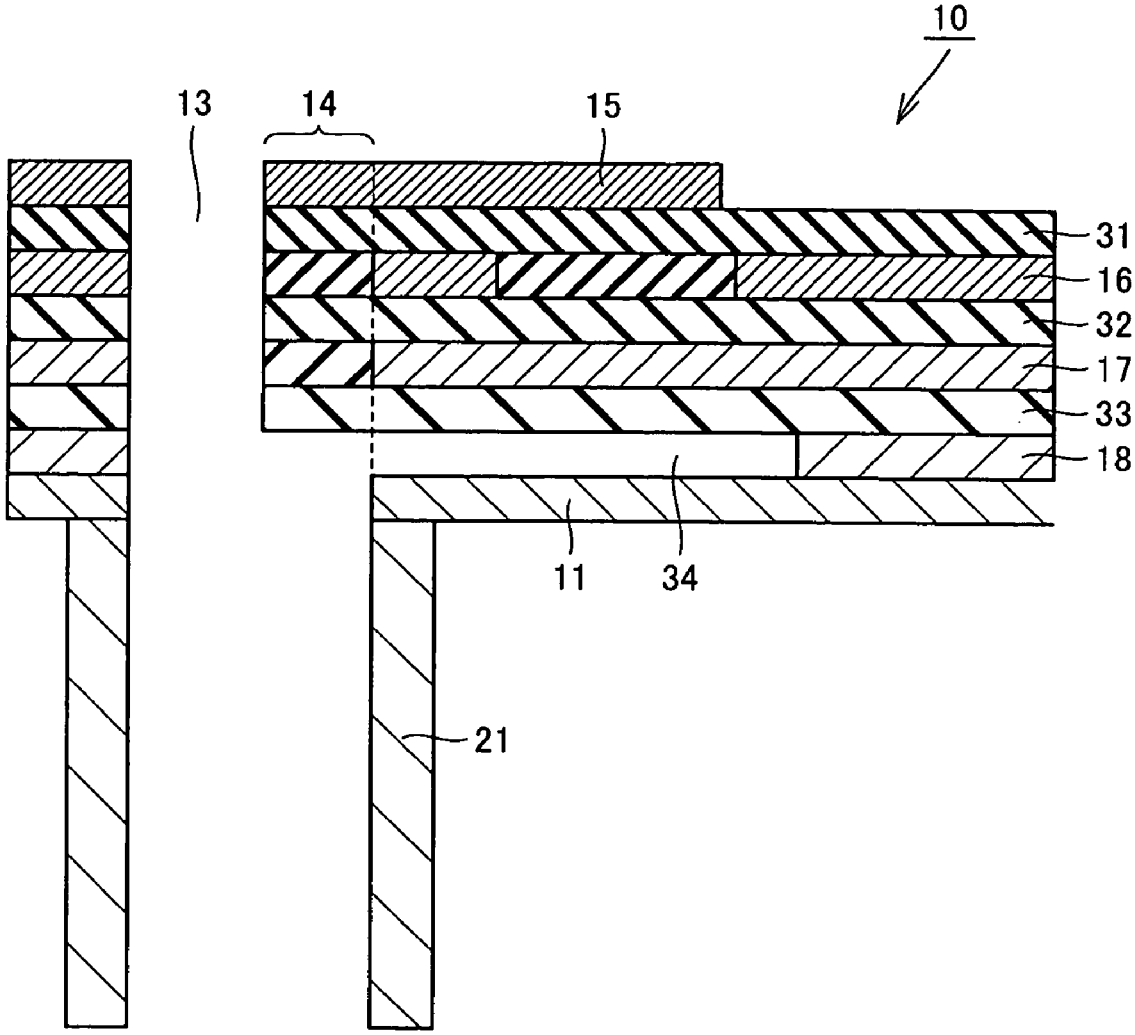
FIGS. 22 and 23 are cross sectional views illustrating LNB four-layer substrates according to ninth and tenth embodiments, respectively, of the invention.

Referring to FIG. 22, in an LNB four-layer substrate 10 of the present embodiment, a first ground conductive layer 16 is formed of the ground conductive layer of FIG. 21, a second ground conductive layer 17 is formed of the ground conductive layer of FIG. 6, and a third ground conductive layer 18 is formed of the ground conductive layer of FIG. 8.

The remaining structure is generally the same as in the first embodiment of FIGS. 1–4, and like components are provided with like reference designations and are not further described.

In the present embodiment, in third ground conductive layer 18, conductor of conductive layer 40 is absent in the region directly below antenna pattern 14. Also, in first ground conductive layer 16, conductor of conductive layer 40 is absent in region 30 that is closer to waveguide 21 than antenna pattern 15 is except in the entire periphery 43 of waveguide aperture 13. Thus, conductor of conductive layer 40 is absent in part of region 30 that is closer to waveguide 21 than antenna pattern 15 is in two ground conductive layers 16 and 18, thereby further restraining electrical interaction among three ground conductive layers 16–18. At the same time, the ground potential may be maintained along periphery 43 of waveguide aperture 13. As a result, deterioration in the passage property of electric wave signals may be restrained.

Tenth Embodiment

Figure 23:
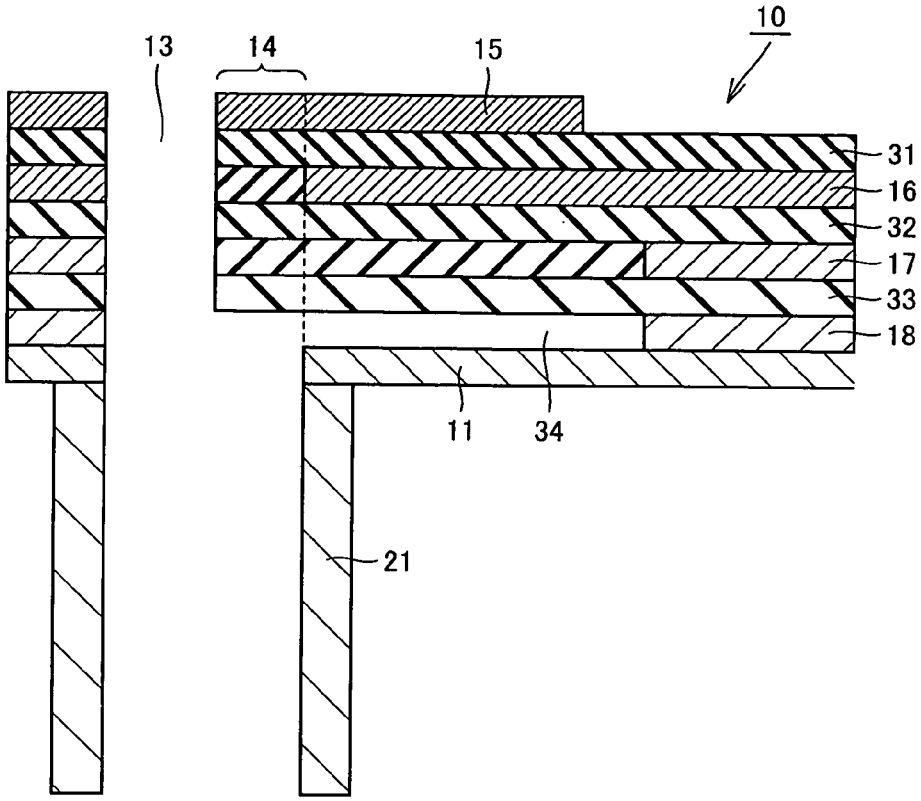

Referring to FIG. 23, in an LNB four-layer substrate 10 according to the present embodiment, a first ground conductive layer 16 is formed of the ground conductive layer of FIG. 6, a second ground conductive layer 17 is formed of the ground conductive layer of FIG. 15, and a third ground conductive layer 18 is formed of the ground conductive layer of FIG. 8.

The remaining structure is generally the same as in the first embodiment of FIGS. 1–4, and like components are provided with like reference designations and are not further described.

The inventors evaluated the passage property in an LNB with LNB four-layer substrate 10 of the present embodiment and that in an LNB with a conventional LNB four-layer substrate 100.

Figure 24:
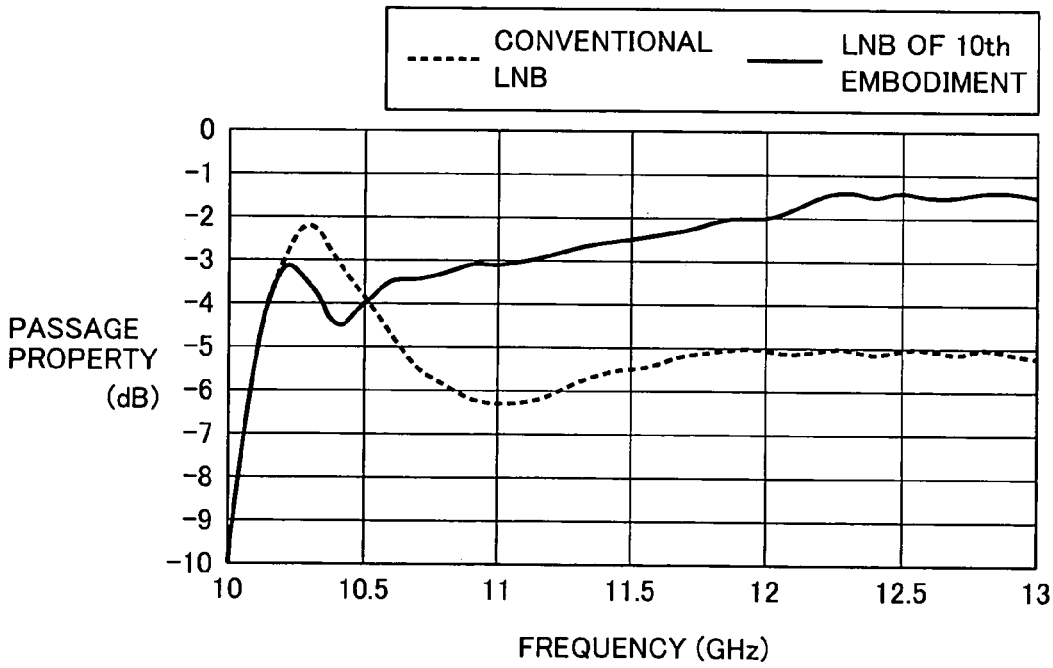
FIG. 24 illustrates the relationship between the passage property and the frequency in each of a conventional LNB and the LNB of the tenth embodiment of the invention.

The results of FIG. 24 illustrate that the LNB of the present embodiment has a higher passage property at frequencies of 10.5–13 GHz.

In the present embodiment, in second ground conductive layer 17., conductor of conductive layer 40 is absent in region 30 that is closer to waveguide 21 than antenna pattern 15 is except in periphery 43 of waveguide aperture 13. Also, in third ground conductive layer 18, conductor of conductive layer 40 is absent in the region directly below antenna pattern 15. Thus, conductor of conductive layer 40 is completely absent in the region directly below antenna pattern 15 in two ground conductive layers 17 and 18, thereby further restraining electrical interaction among three ground conductive layers 16–18. At the same time, the ground potential can be maintained around waveguide aperture 13. As a result, deterioration in the passage property of electric wave signals may be restrained.

Although the present embodiment shows second ground conductive layer 17 being formed of the ground conductive layer of FIG. 15 and third ground conductive layer 18 being formed of the ground conductive layer of FIG. 8, the present invention is not limited thereto and it suffices if conductor is absent in the region directly below the antenna pattern in at least two ground conductive layers.

Eleventh Embodiment

Figure 25:
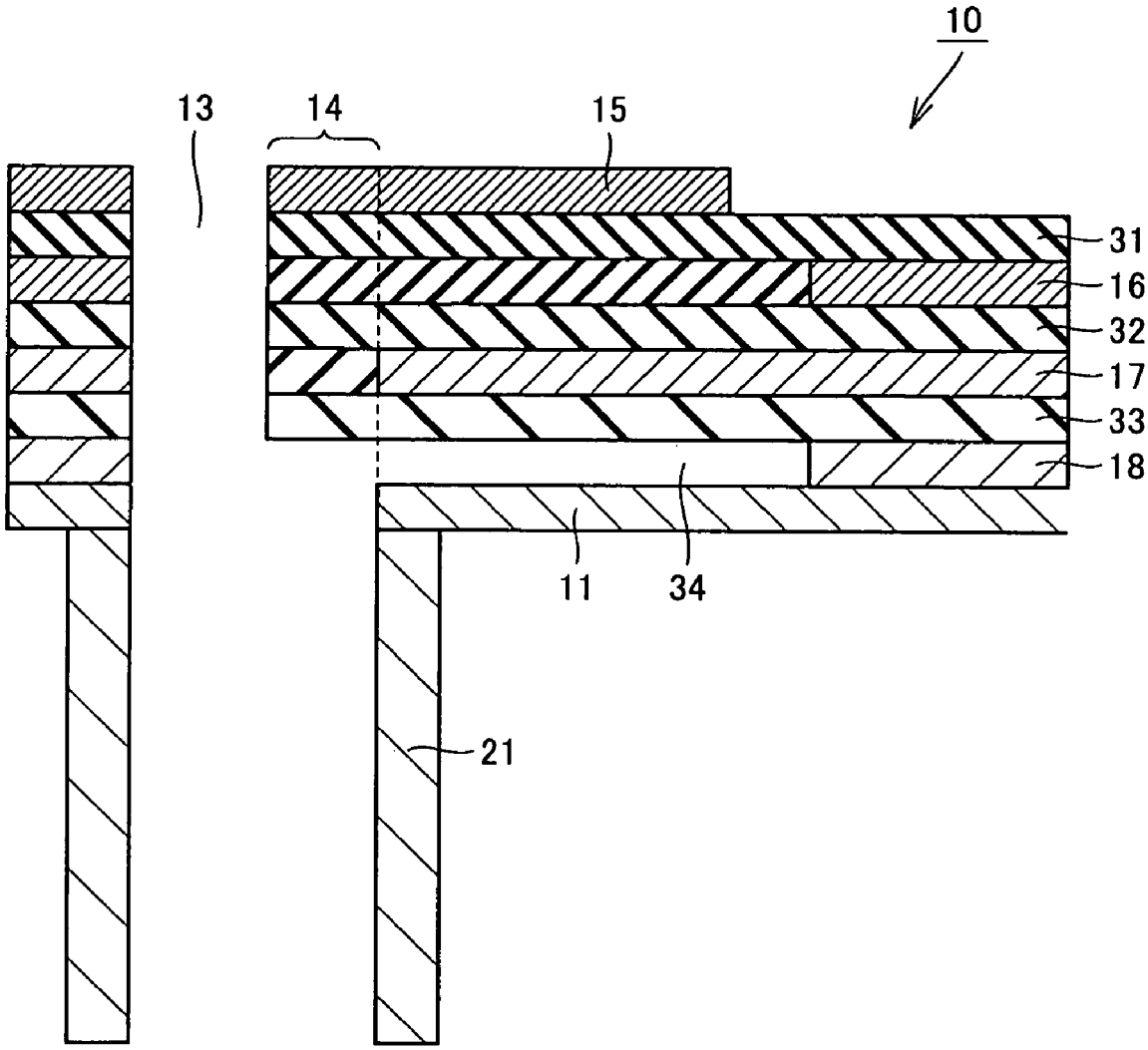
FIGS. 25 to 27 are cross sectional views illustrating LNB four-layer substrates according to eleventh to thirteenth embodiments, respectively, of the invention.

Referring to FIG. 25, in an LNB four-layer substrate 10 of the present embodiment, a first ground conductive layer 16 is formed of the ground conductive layer of FIG. 15, a second ground conductive layer 17 is formed of the ground conductive layer of FIG. 6, and a third ground conductive layer 18 is formed of the ground conductive layer of FIG. 8.

The remaining structure is generally the same as in the first embodiment of FIGS. 1–4, and like components are provided with like reference designations and are not further described.

In the present embodiment, in first ground conductive layer 16, conductor of conductive layer 40 is absent in region 30 that is closer to waveguide 21 than antenna pattern 15 is except in periphery 43 of waveguide aperture 13. Also, in third ground conductive layer 18, conductor of conductive layer 40 is absent in the region directly below antenna pattern 15. Thus, conductor of conductive layer 40 is completely absent in the region directly below antenna pattern 15 in two ground conductive layers 16 and 18, thereby further restraining electrical interaction among three ground conductive layers 16–18. At the same time, the ground potential may be maintained around waveguide aperture 13. As a result, deterioration in the passage property of electric wave signals may be restrained.

Twelfth Embodiment

Figure 26:
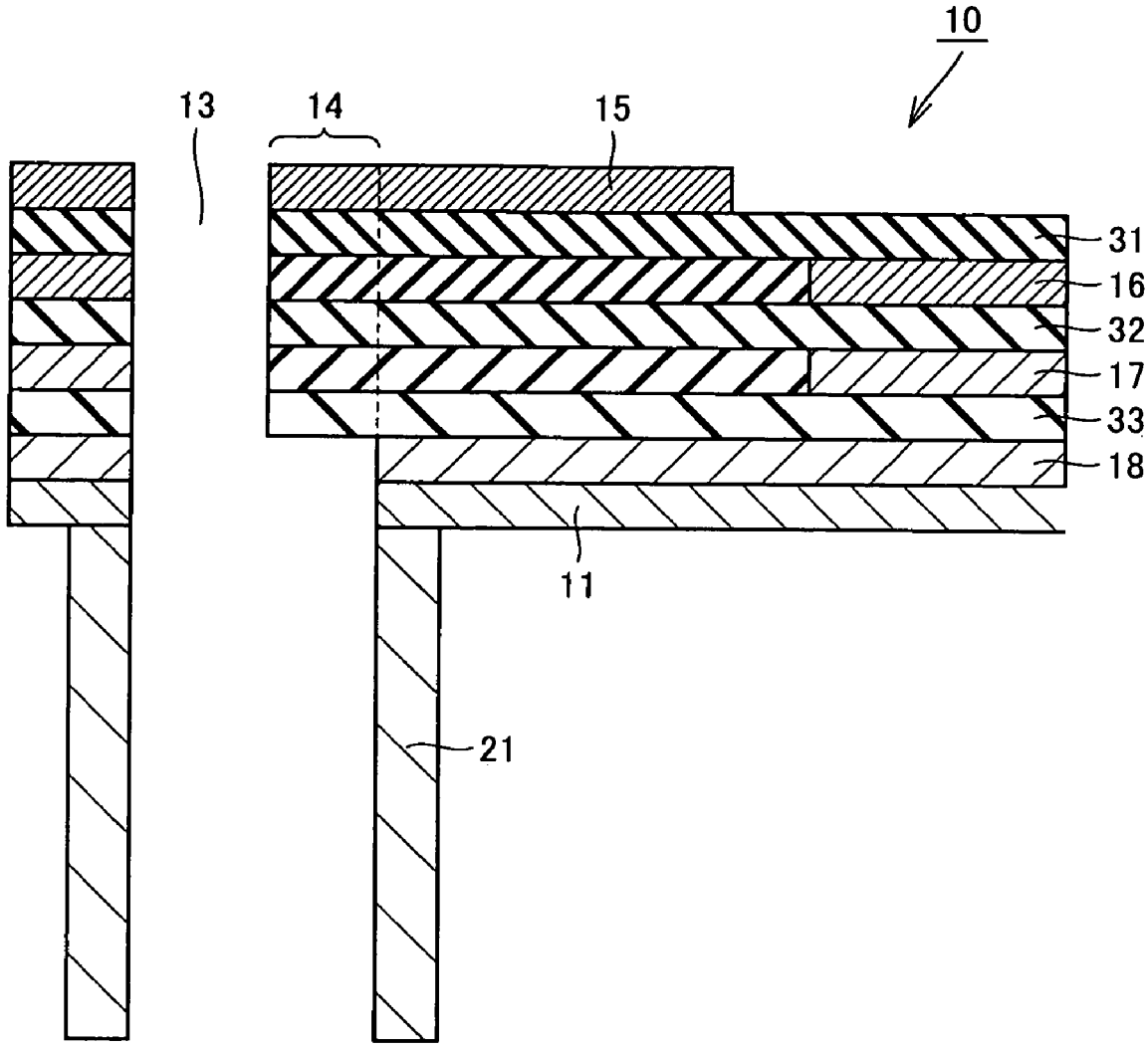

Referring to FIG. 26, in an LNB four-layer substrate 10 of the present embodiment, first and second ground conductive layers 16 and 17 are formed of the ground conductive layer of FIG. 15, and a third ground conductive layer 18 is formed of the ground conductive layer of FIG. 6.

The remaining structure is generally the same as in the first embodiment of FIGS. 1–4, and like components are provided with like reference designations and are not further described.

In the present embodiment, in first and second ground conductive layers 16 and 17, conductor of conductive layer 40 is absent in region 30 that is closer to waveguide 21 than antenna pattern 15 is except in periphery 43 of waveguide aperture 13. Thus, conductor of conductive layer 40 is completely absent in the region directly below antenna pattern 15 in two ground conductive layers 16 and 17, thereby further restraining electrical interaction among three ground conductive layers 16–18. At the same time, the ground potential may be maintained around waveguide aperture 13. As a result, deterioration in the passage property of electric wave signals may be restrained.

Thirteenth Embodiment

Figure 27:
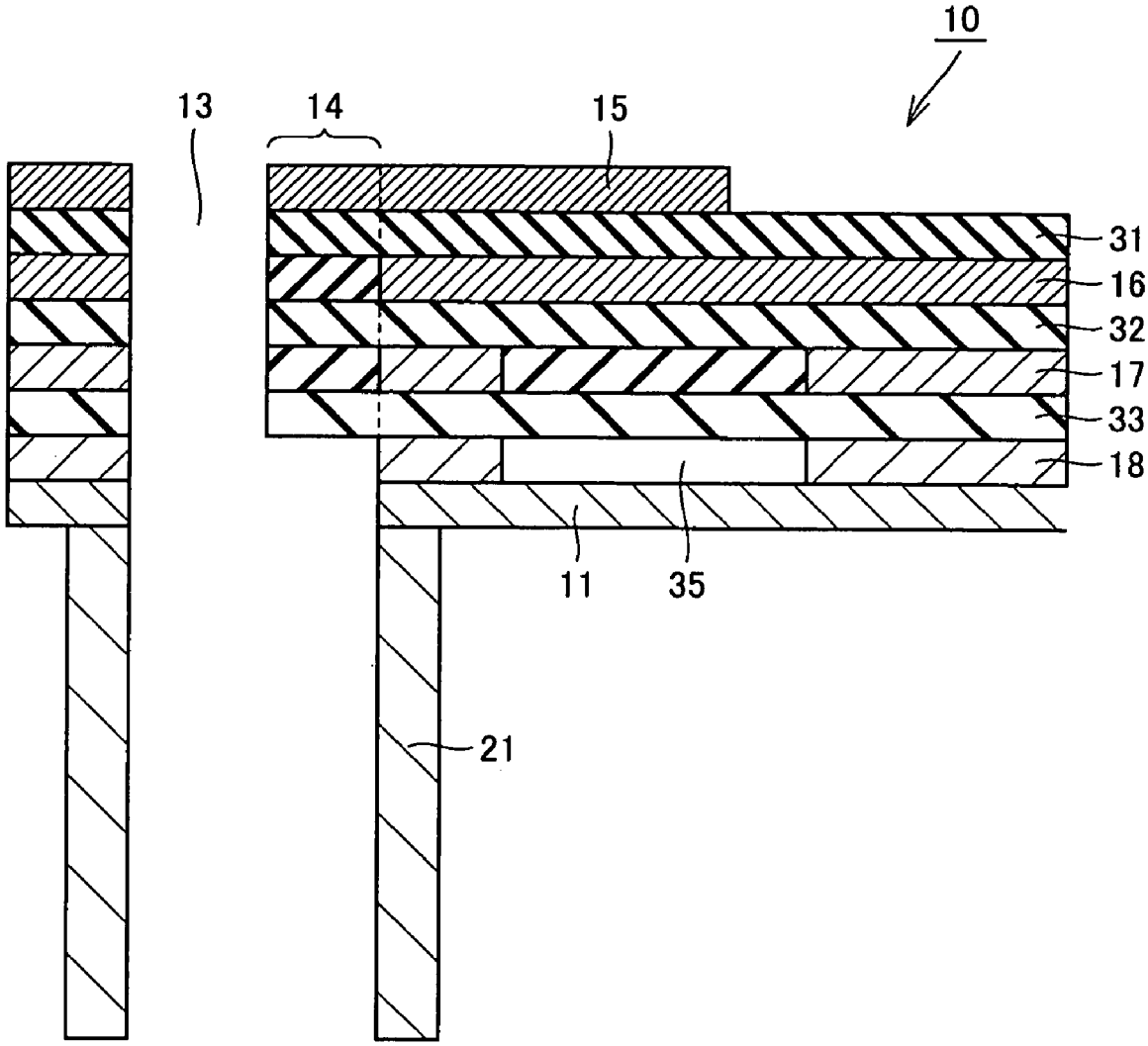

Referring to FIG. 27, in an LNB four-layer substrate 10 of the present embodiment, a first ground conductive layer 16 is formed of the ground conductive layer of FIG. 6, a second ground conductive layer 17 is formed of the ground conductive layer of FIG. 21, and a third ground conductive layer 18 is formed of the ground conductive layer of FIG. 18.

The remaining structure is generally the same as in the first embodiment of FIGS. 1–4, and like components are provided with like reference designations and are not further described.

The inventors evaluated the passage property in an LNB with LNB four-layer substrate 10 of the present embodiment and that in an LNB with a conventional LNB four-layer substrate 100.

Figure 28:
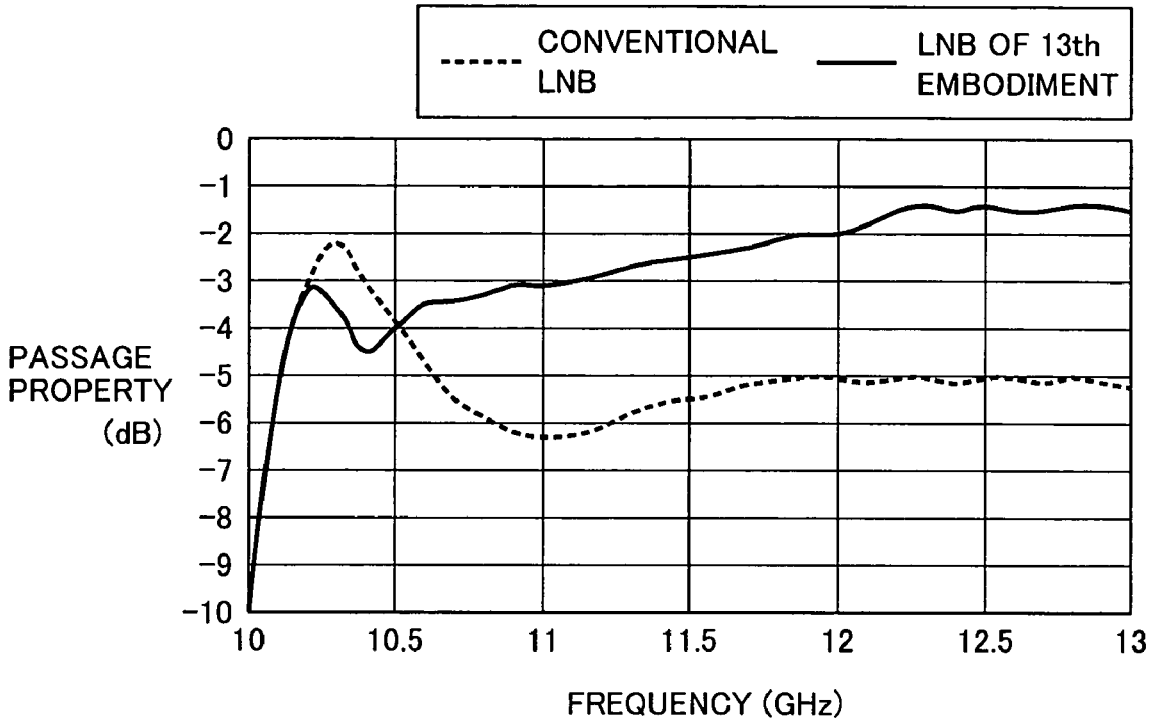
FIG. 28 illustrates the relationship between the passage property and the frequency in each of a conventional LNB and the LNB of the thirteenth embodiment of the invention.

The results of FIG. 28 illustrate that the LNB of the present embodiment has a higher passage property at frequencies of 10.7–13 GHz.

According to the present embodiment, the ground potential can be maintained in the entire periphery 43 of waveguide aperture 13 in all of three ground conductive layers 16–18. Moreover, in second ground conductive layer 17, conductor of conductive layer 40 is absent in region 30 that is closer to waveguide 21 than antenna pattern 15 is except in the entire periphery 43 of waveguide aperture 13. Further, in third ground conductive layer 18, conductor of conductive layer 40 is absent in part of the region directly below antenna pattern 15. Thus, in two ground conductive layers 17 and 18, conductor of conductive layer 40 is absent in part of region 30 that is closer to waveguide 21 than antenna pattern 15 is, thereby restraining electrical interaction among three ground conductive layers 16–18. As a result, deterioration in the passage property of electric wave signals may be restrained.

Fourteenth Embodiment

Figure 29:
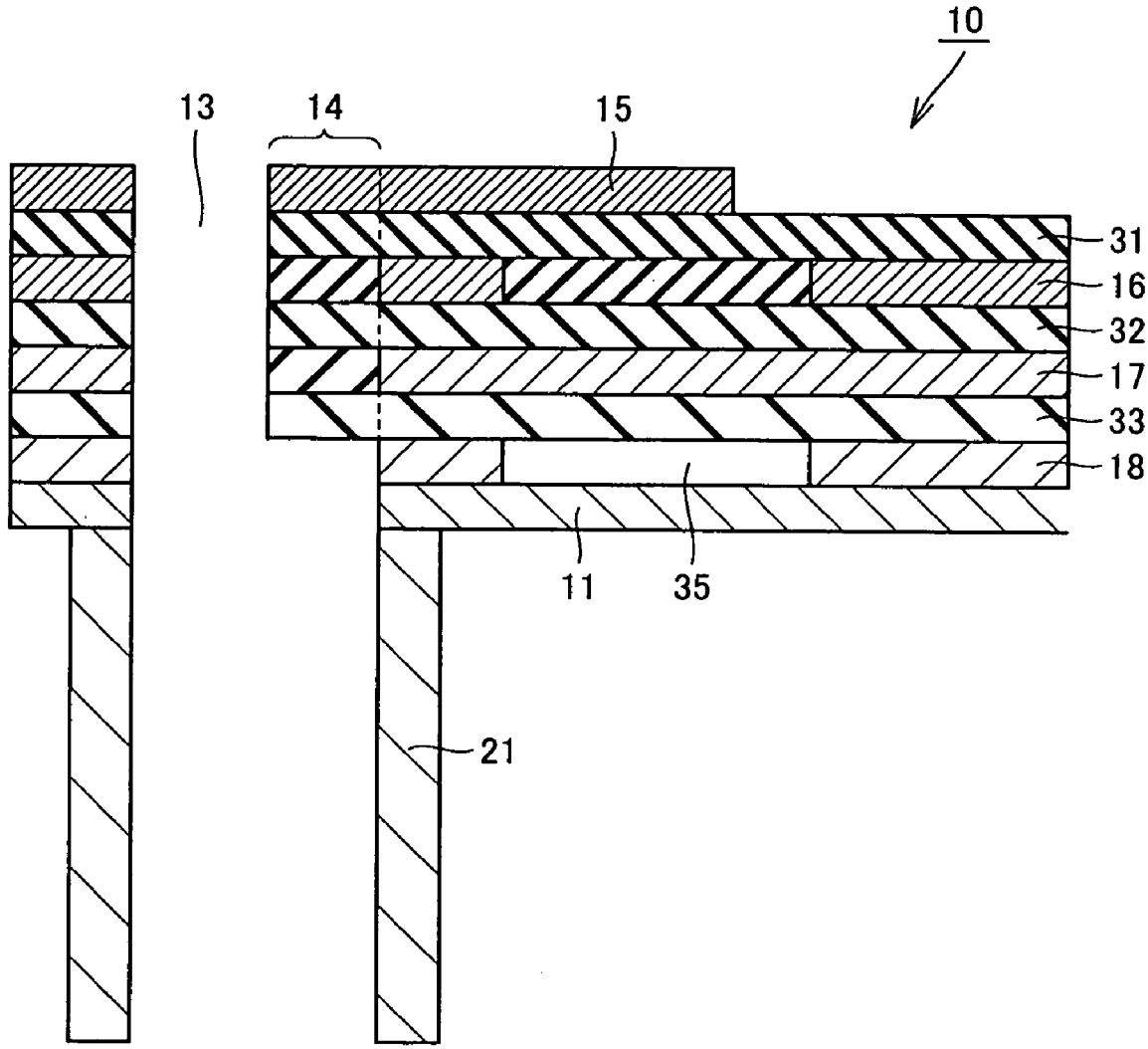
FIGS. 29 and 30 are cross sectional views illustrating LNB four-layer substrates according to fourteenth and fifteenth embodiments, respectively, of the invention.

Referring to FIG. 29, in an LNB four-layer substrate 10 of the present embodiment, a first ground conductive layer 16 is formed of the ground conductive layer of FIG. 21, a second ground conductive layer 17 is formed of the ground conductive layer of FIG. 6, and a third ground conductive layer 18 is formed of the ground conductive layer of FIG. 18.

The remaining structure is generally the same as in the first embodiment of FIGS. 1–4, and like components are provided with like reference designations and are not further described.

According to the present embodiment, the ground potential may be maintained in the entire periphery 43 of waveguide aperture 13 in all of three ground conductive layers 16–18. Moreover, in first ground conductive layer 16, conductor of conductive layer 40 is absent in region 30 that is closer to waveguide 21 than antenna pattern 15 is except in the entire periphery 43 of waveguide aperture 13. Further, in third ground conductive layer 18, conductor of conductive layer 40 is absent in part of the region directly below antenna pattern 15. Thus, in two ground conductive layers 16 and 18, conductor of conductive layer 40 is absent in part of region 30 that is closer to waveguide 21 than antenna pattern 15 is, thereby restraining electrical interaction among three ground conductive layers 16–18. As a result, deterioration in the passage property of electric wave signals may be restrained.

Fifthteenth Embodiment

Figure 30:
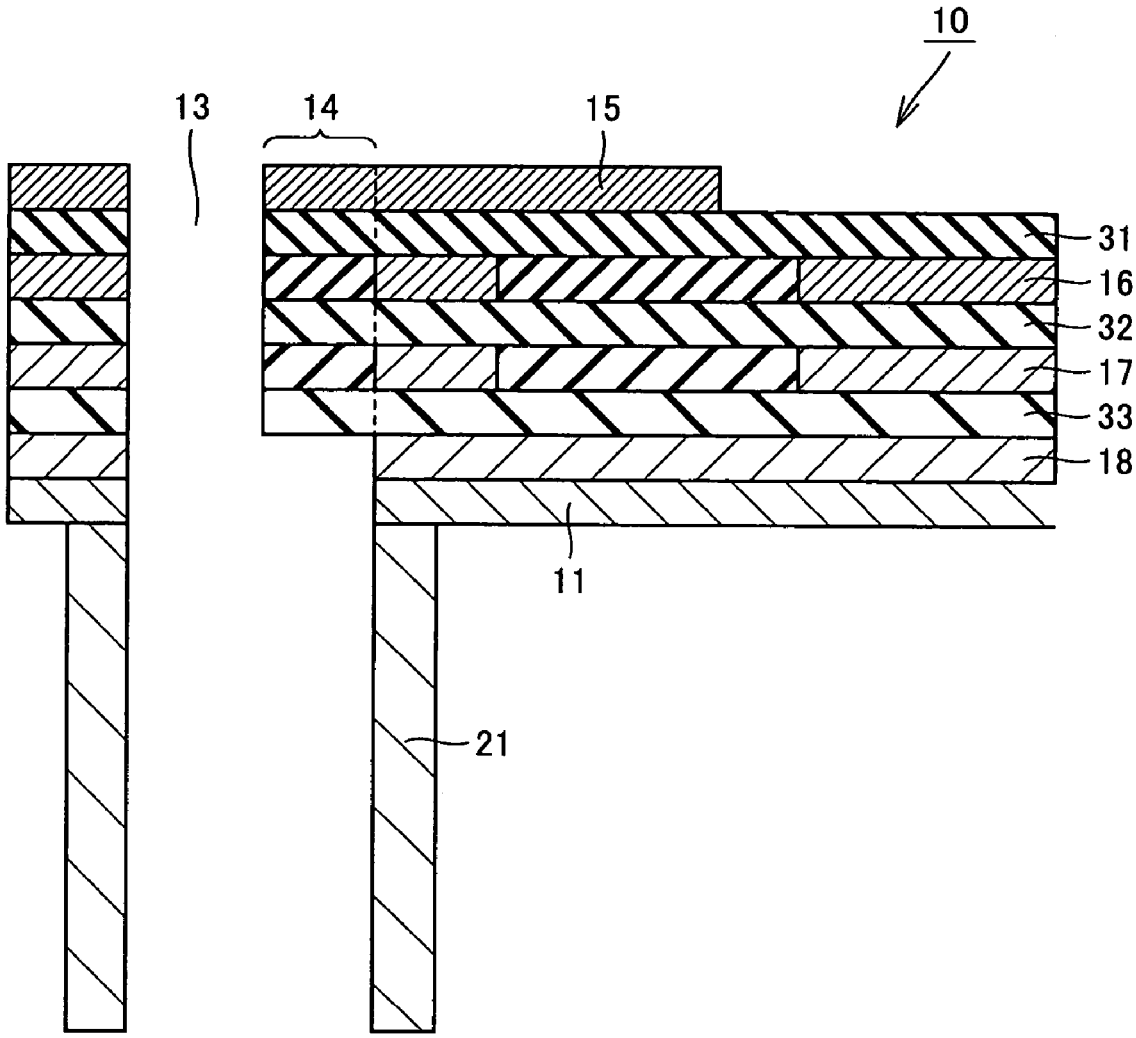
Figure 31:
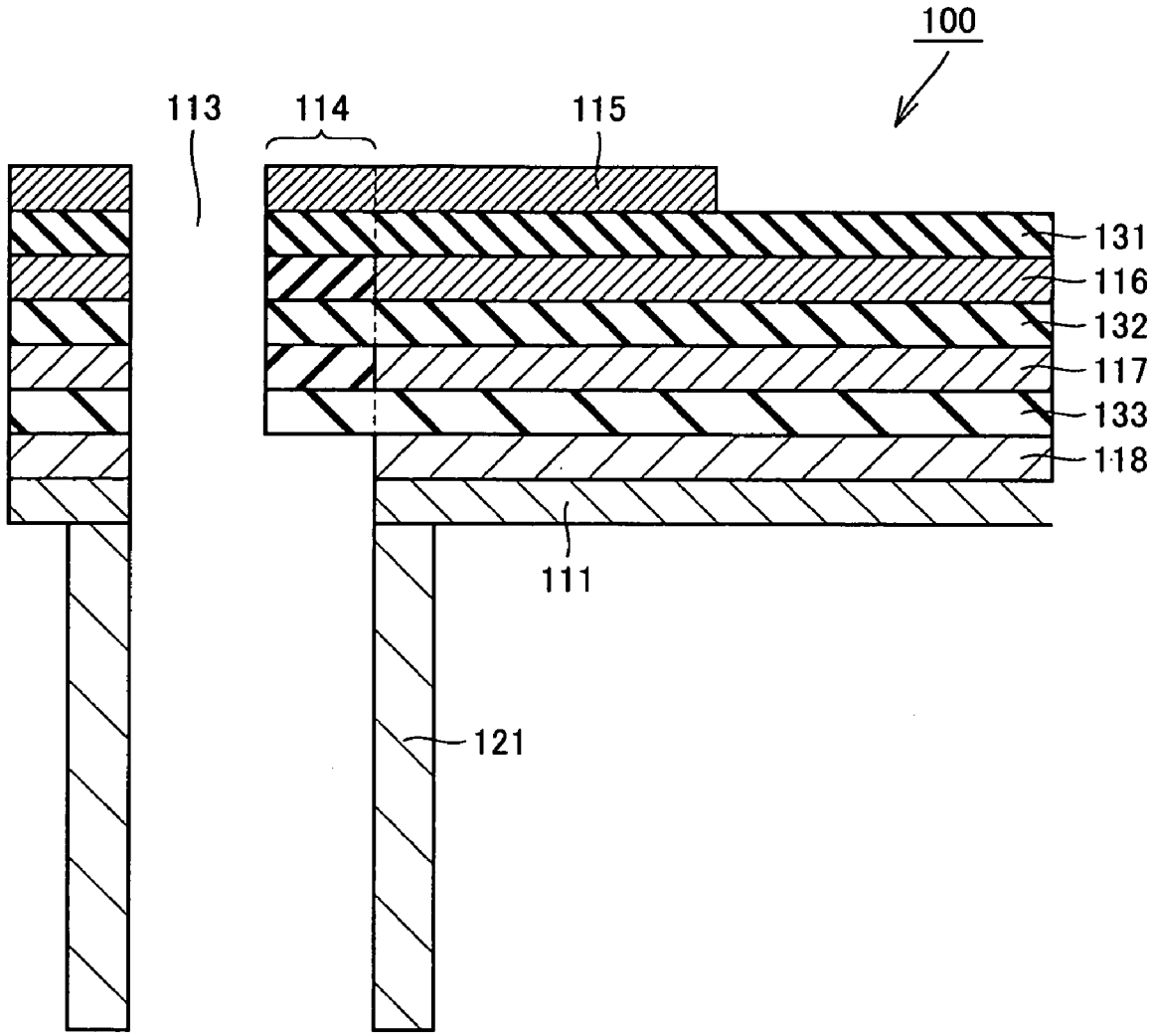
FIG.31 PRIOR ART
FIG. 31 is a cross sectional view of a conventional LNB four-layer substrate.

Referring to FIG. 30, in an LNB four-layer substrate 10 of the present embodiment, first and second ground conductive layers 16 and 17 are formed of the ground conductive layer of FIG. 21, and a third ground conductive layer 18 is formed of the ground conductive layer of FIG. 6.

The remaining structure is generally the same as in the first embodiment of FIGS. 1–4, and like components are provided with like reference designations and are not further described.

According to the present embodiment, the ground potential may be maintained along the entire periphery of waveguide aperture 13 in all of three ground conductive layers 16–18. Moreover, in first and second ground conductive layers 16 and 17, conductor of conductive layer 40 is absent in region 30 that is closer to waveguide 21 than antenna pattern 15 is except in the entire periphery 43 of waveguide aperture 13. Thus, in two ground conductive layers 16 and 17, conductor of conductive layer 40 is absent in part of region 30 that is closer to waveguide 21 than antenna pattern 15 is, thereby restraining electrical interaction among three ground conductive layers 16–18. As a result, deterioration in the passage property of electric wave signals may be restrained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A multi-layer substrate for a low noise block down converter, comprising:

an antenna pattern conveying an electric wave signal carried along a waveguide, at least two ground conductive layers stacked below said antenna pattern with a dielectric layer therebetween, wherein, in at least one of said at least two ground conductive layers, a conductor is absent in at least part of a region that is closer to said waveguide than said antenna pattern is.

2. The multi-layer substrate for the low noise block down converter according to claim 1, wherein, in at least one of said at least two ground conductive layers, said conductor is absent in a region directly below said antenna pattern.

3. The multi-layer substrate for the low noise block down converter according to claim 2, having three ground conductive layers as said at least two ground conductive layers, wherein, in the same level as that in which one of first and second ground conductive layers from above among said three ground conductive layers is provided, a dielectric is provided in a region that is closer to said waveguide than said antenna pattern is and, in the same level as that in which a third ground conductive layer from among said three ground conductive layers is provided, a notch is provided in a region directly below said antenna pattern.

4. The multi-layer substrate for the low noise block down converter according to claim 2, having three ground conductive layers as said at least two ground conductive layers, wherein, in the same levels as those in which first and second ground conductive layers from above among said three ground conductve layers are provided, a dielectric is provided in a region that is closer to said waveguide than said antenna pattern is.

5. The multi-layer substrate for the low noise block down converter according to claim 2, wherein a waveguide aperture is formed penetrating said at least two ground conductive layers and said dielectric layer and, in all of the same levels as those in which said at least two ground conductive layers are provided, said conductor is provided around said waveguide aperture.

6. The multi-layer substrate for the low noise block down converter according to claim 5, having three ground conductive layers as said at two ground conductive layers, wherein, in a third ground conductive layer from above among said three ground conductive layers, a notch is provided in a region directly below said antenna pattern.

7. The multi-layer substrate for the low noise block down converter according to claim 5, having three ground conductive layers as said at least two ground conductive layers, wherein, in the same level as that in which one of first and second ground conductive layers from among said three ground conductive layers is provided, a dielectric is provided in at least part of a region that is closer to said waveguide than said antenna pattern is.

8. The multi-layer substrate for the low noise block down converter according to claim 5, wherein, in at least two of said at least two ground conductive layers, said conductor is absent in at least part of a region that is closer to said waveguide than said antenna pattern is.

9. The multi-layer substrate for the low noise block down converter according to claim 8, having three ground conductive layers as said at least two ground conductive layers, wherein, in the same level as that in which first ground conductive layer from above among said three ground conductive layers is provided, a dielectric is provided in at least part of a region that is closer to said waveguide than said antenna pattern is and, in a third ground conductive layer from above among said three ground conductive layers, a notch is provided in at least part of a region directly below said antenna pattern.

10. The multi-layer substrate for the low noise block down converter according to claim 8, having three ground conductive layers as said at least two ground conductive layers, wherein, in the same level as that in which one of first and second ground conductive layers from above among said three ground conductive layers is provided, a dielectric is provided in at least part of a region that is closer to said waveguide than said antenna pattern is and, in a third ground conductive layer from above among said three ground conductive layers, a notch is provided in a region directly below said antenna pattern.

11. The multi-layer substrate for the low noise block down converter according to claim 8, wherein, in at least two of said at least two ground conductive layers, said conductor is absent in a region directly below said antenna pattern.

12. The multi-layer substrate for the low noise block down converter according to claim 11, having three ground conductive layers as said at least two ground conductive layers, wherein, in the same level as that in which one of first and second ground conductive layers from above among said three ground conductive layers is provided, a dielectric is provided in at least part of a region that is closer to said waveguide than said antenna pattern is and, in a third ground conductive layer from above among said three ground conductive layers, a notch is provided in a region directly below said antenna pattern.

13. The multi-layer substrate for the low noise block down converter according to claim 11, having three ground conductive layers as said at least two ground conductive layers, wherein, in the same levels as those in which first and second ground conductive layers from above among said three ground conductive layers are provided, a dielectric is provided in at least part of a region that is closer to said waveguide than said antenna pattern is.

14. The multi-layer substrate for the low noise block down converter according to claim 1, wherein a waveguide aperture is formed penetrating said at least two ground conductive layers and said dielectric layer and, in all of the same levels as those in which said at least two ground conductive layers are provided, said conductor is provided surrounding an entire periphery of said waveguide aperture.

15. The multi-layer substrate for the low noise block down converter according to claim 14, having three ground conductive layers as said at least two ground conductive layers, wherein, in the same level as that in which one of first and second ground conductive layers from above among said ground conductive layers is provided, a dielectric is provided in at least part of a region that is closer to said waveguide than said antenna pattern is and, in a third ground conductive layer from above among said three ground conductive layers, a notch is provided in at least part of a region directly below said antenna pattern.

16. The multi-layer substrate for the low noise block down converter according to claim 14, having three ground conductive layers as said at least two ground conductive layers, wherein, in the same levels as those in which first and second ground conductive layers from above among said three ground conductive layers are provided, a dielectric is provided in at least part of a region that is closer to said waveguide than said antenna pattern is.

* * * * *